US012559820B2

(12) United States Patent
Román Espinoza et al.

(10) Patent No.: US 12,559,820 B2
(45) Date of Patent: Feb. 24, 2026

(54) ORE RESETTING PROCESS FOR COPPER LEACHING

(71) Applicant: Ceibo Inc., Santiago (CL)

(72) Inventors: Anselmo Enrique Román Espinoza, Santiago (CL); Nélida Emilia Heresi Milad, Santiago (CL); Catalina Urrejola Santa María, Santiago (CL); Nicole Andrea Werner Ratto, Santiago (CL); Nicole Stephanie Guajardo Contreras, Santiago (CL); Alejandro Eduardo Briso Retamale, Santiago (CL)

(73) Assignee: Ceibo Inc., Santiago (CL)

( * ) Notice: Subject to any disclaimer, the term of this patent is extended or adjusted under 35 U.S.C. 154(b) by 0 days.

(21) Appl. No.: 19/235,398

(22) Filed: Jun. 11, 2025

(65) Prior Publication Data

US 2025/0305087 A1 Oct. 2, 2025

Related U.S. Application Data

(63) Continuation of application No. PCT/US2024/060000, filed on Dec. 13, 2024.

(60) Provisional application No. 63/615,354, filed on Dec. 28, 2023.

(51) Int. Cl.
*C22B 15/00* (2006.01)

(52) U.S. Cl.
CPC ..... *C22B 15/001* (2013.01); *C22B 15/0071* (2013.01)

(58) Field of Classification Search
None
See application file for complete search history.

(56) References Cited

U.S. PATENT DOCUMENTS

| | | | | |
|---|---|---|---|---|
| 5,246,486 | A | 9/1993 | Brierley et al. | |
| 2007/0049992 | A1 | 3/2007 | Freeberg | |
| 2007/0125198 | A1 | 6/2007 | Rossiter | |
| 2014/0212346 | A1* | 7/2014 | Xia | C22B 11/04 423/1 |
| 2016/0258036 | A1* | 9/2016 | Rautenbach | C25C 1/12 |

(Continued)

FOREIGN PATENT DOCUMENTS

| | | | | |
|---|---|---|---|---|
| CN | 112958579 | A | 6/2021 | |
| WO | WO-2009146485 | A1 * | 12/2009 | C22B 3/16 |

(Continued)

OTHER PUBLICATIONS

Williamson, Adam J., et al. Selective metal extraction by biologically produced siderophores during bioleaching from low-grade primary and secondary mineral resources, Jan. 17, 2021, bioRxiv (Year: 2021).*

(Continued)

*Primary Examiner* — Keith D. Hendricks
*Assistant Examiner* — Nikolas Takuya Pullen
(74) *Attorney, Agent, or Firm* — PEARL COHEN ZEDEK LATZER BARATZ LLP

(57) ABSTRACT

Methods, compositions and systems are provided that improve recovery of copper from previously leached copper ores. A reset solution comprising a chelating agent and a reducing agent is provided to a heap of previously leached and passivated ore to improve copper recovery kinetics in subsequent leaching stages.

13 Claims, 10 Drawing Sheets

(56) References Cited

U.S. PATENT DOCUMENTS

| | | | | |
|---|---|---|---|---|
| 2017/0306440 | A1 | 10/2017 | Hein et al. | |
| 2020/0224290 | A1 | 7/2020 | Oraby et al. | |
| 2022/0074067 | A1 | 3/2022 | Pesavento et al. | |
| 2023/0086259 | A1 | 3/2023 | Lyons | |
| 2023/0203618 | A1* | 6/2023 | Chibwana ..... | C22B 15/0073 423/28 |

FOREIGN PATENT DOCUMENTS

| | | | |
|---|---|---|---|
| WO | WO 2012/081953 | A1 | 6/2012 |
| WO | WO 2016/027158 | A1 | 2/2016 |
| WO | WO 2022/056622 | A1 | 3/2022 |

OTHER PUBLICATIONS

David Michaud, Chalcopyrite Leaching, May 5, 2017, 911 Metallurgist (Year: 2017).*

* cited by examiner

ORE RESETTING PROCESS FOR COPPER LEACHING

RELATED APPLICATION DATA

This application is a continuation of International Application No. PCT/US2024/060000, filed Dec. 13, 2024, which claims the benefit of U.S. Provisional Application No. 63/615,354 filed Dec. 28, 2023, entitled "ORE RESETTING PROCESS FOR COPPER LEACHING", both of which are incorporated herein by reference.

FIELD OF THE INVENTION

The present invention relates to a hydrometallurgical process and system for heap leaching of metal ores. In embodiments, the process and system of the invention relate to an ore chemical reset process and leaching copper ore.

BACKGROUND OF THE INVENTION

Heap leaching is the fundamental hydrometallurgical process that involves the aqueous chemical extraction of valuable metals from metal-containing ores. This is followed by solvent extraction (SX) and electrowinning (EW), which complete the cycle of the extraction of the metal of interest. The general process entails crushing the ore followed by agglomeration of the crushed ore with particular solutions depending on the type of ore. Subsequently, the agglomerated ore is stacked on leach pads to form the heap. In certain cases, the ore is stacked and leached without being crushed and agglomerated previously, so-called run of mine (ROM). For copper leaching, copper ores such as oxides are stacked, and then, the heap of ore is irrigated with leaching solutions comprising, for example, sulfuric acid ($H_2SO_4$), water and other chemicals and trickled through the heap, thereby facilitating the dissolution of the $Cu^{2+}$ ions.

Conventional leaching processes applied to oxide ores use acid solutions and comprise different steps. The ore is crushed, and it is mixed with acid plus water and/or raffinate from SX and EW processes. The mixture of acid with water and/or raffinate cure allows for dissolution of copper from oxide ores and acidifying the heap. Additionally, the irrigated acid plus water and/or raffinate drips through the heap until reaching the collection ponds after a period of months.

Most of the copper sulfides, primary and secondary, require a solution with catalysts to dissolve the ores into water-soluble copper sulfates, enabling a subsequent copper recovery by conventional hydrometallurgical processes. The catalyzing agents used for this purpose are chemical reagents such as iron, oxidizing bacteria and a few others in acid conditions. However, this leaching process is hindered by diverse chemical elements present in the leaching solution, from impurities in the ore and byproducts of the process, which form an impermeable layer on the surface of the ore. This may be perceived as a period of stagnation in the recovery kinetics followed by cycles of sustained incremental copper recovery.

The prevalence of low-grade copper deposits is increasing, with the primary ore mineral being chalcopyrite (Cpy). This specific type of refractory sulfide ore is currently the most abundant, comprising approximately 70% of the world's copper reserves. The industrial extraction of copper from Cpy has largely been conducted through pyrometallurgical processes which are unsustainable from an environmental perspective.

The leaching of sulfide ores using conventional hydrometallurgical processes presents a challenge. The use of catalysts have the primary goal of addressing the refractory nature of this ore by converting it into soluble copper sulfates. Nevertheless, these leaching processes tend to be inefficient, with a copper recovery of less than 40%. The underlying causes for these inefficient recovery rates may be attributed to the operational conditions that induce the formation of leaching insoluble subproducts on the surface of the ore, hindering further ore dissolution.

Three principal categories of this passive layer formation may be identified. The first category is the layer of elemental sulfur ($S^0$) forming the subsequent sulfide and polysulfide layers deposited over the ore. This is a sulfur-rich layer of sulfides and polysulfides formed with a general formula of $Cu_{1-x}Fe_{1-y}S_2$ (wherein y>>x) due to the dissolution of iron atoms occurring at a faster rate than that of copper ions within the Cpy crystal lattice. The remaining depleted metal-containing ore may become thicker and undergo a restructuring process that results in the formation of $S_8$-like elemental sulfur. This layer exhibits resistance to acid and ferric exposure in an oxidative leaching solution as described in the prior art.

The second category is the precipitation of jarosite ($KFe_3(SO_4)_2(OH)_6$), thiosulfate/thiosulfite salts in the microchannels and micropores within the surface of the Cpy particles. These precipitates have the chemical formula of $MFe_3^{3+}(OH)_6(SO_4)_2$, where M represents either Na, K, $H_3O^+$, $NH_4^+$, including *Schwertmannite* $(Fe^{3+})_{16}O_{16}(OH)_{9.6}(SO_4)_{3.2}^-$ They are the result of the accumulation of iron (III) as insoluble compounds due to prolonged periods of leaching at specific ferric ion concentrations, pH levels and oxidation-reduction potential (ORP) conditions at the interphase of the ore surface/leaching solution. The precipitates affect the permeability of the heap. Prior art reports that during bioleaching, the activity of iron-oxidizing bacteria, such as *Acidithiobacillus ferrooxidans* or *Leptospirillum ferriphilum*, may result in the accumulation of ferric ions. This accumulation, in conjunction with certain operational conditions, may lead to the formation of insoluble jarosite species, such as *schwertmannite* ($(Fe^{3+})_{16}O_{16}(OH)_{9.6}(SO_4)_{3.2}$) or *limonite* ($FeO(OH)\cdot nH_2O$).

The third category of passivation layer formation is caused by the secretion of extracellular polymeric substances (EPS) which enables bacterial attachment to the ore surface during the bioleaching process. However, some phenomena within the heap can result in the precipitation of iron as jarosite and hydrated iron oxides on the EPS membrane. This surrounds the bacterial colony attached to the Cpy particle surface, thereby inhibiting bioleaching and passivating the Cpy particles.

Several strategies have been proposed to address the formation of passivation layers over refractory ores like Cpy to enhance copper leaching kinetics. International Application Publication No. WO 2012/081953A1 describes an aqueous solution containing sulfuric acid and other agents, including organic nitrile (acetonitrile) and acetone. Furthermore, complexing agents are included to prevent the formation of undesirable layers over the minerals. Inasmuch this process is designed into a single step and the chemical reagents used may present a risk to mining sites due to the nature of the hazardous solutions employed.

International Application Publication No. WO 2016/027158 describes an electrochemical hydrometallurgical process utilizing aqueous solution with a high redox potential for leaching primary sulfide minerals. By controlling the redox potential applied to the electrochemical cell, it is possible to prevent the formation of passivating species on the mineral surface. It discloses a reactor that employs a range of different potentials to extract the specific elements. Therefore, it is not yet clear how these methods might be applied on a large-scale commercial project for copper recovery, such as a heap leaching operation.

U.S. Patent Application Publication No. 2020/224290 outlines a process for the recovery of precious and chalcophile metals from a range of materials, including tailings, ore concentrate and other waste materials containing metals in a reactor. The leaching solution comprises an aqueous amino acid thiourea solution for scavenging free metal ions and a gaseous oxidant agent, while maintaining a low ORP, and pH levels of 0 to 6. Although the process addresses the issue of iron ions and their precipitation, the use of these chemical reagents in the same leaching solution makes it challenging to control the level of iron removal from the ore across different pH and redox potential ranges. Furthermore, the iron removal occurs within the confines of the reactor.

U.S. Patent Application Publication No. 2017/306440 depicts a process comprising six sequential stages. It employs a sorbent and leaching agents for the extraction of metals from a variety of materials including ores residues, concentrate ores, tailings and slags. The process aims to reduce the consumption of leaching reagents and increase metal recovery. It relies on the absorption effect of certain materials, including ion exchange resins, activated carbon, and zeolites. The materials may be combined for additional leaching, and then separated from the leached metal in a subsequent treatment step to recover the final target metal. Nevertheless, this introduces a degree of complexity to the leaching process, as it is unclear how the solid sorbent materials will be separated from the metal ore on an industrial scale and the solution is more related to the recovery of metallic values from secondary resources of mining and from other types of industries.

U.S. Pat. No. 5,246,486 describes a process for bio-oxidation of static heaps for the extraction of copper and gold from low-grade ores. The process also includes a pretreatment stage, which serves to increase the number of soluble ions present in the solution. The bio-oxidation treatment allows for bacterial activity over the ore prior to the leaching step, resulting in metal solubilization. The bacterial communities oxidized sulfur and iron ions present in the mineral, with the *Acidithiobacillus* and *Leptospirillum* genera being particularly effective for this purpose. This process is not designed for copper solubilization as the target metal of the leaching process (rather as a byproduct of the leaching), and it utilizes alkaline pH levels of 9 to 11 with a cyanide leaching solution.

International Application Publication No. WO 2022/056622 which is incorporated by reference for its teaching related to copper extraction in acid aqueous solutions, a nonionic surfactant wetting agent, and a thiocarbonyl functional group compound as a catalyst and $FeSO_4$ under low concentrations in solution at the agglomeration stage of the ore. Subsequently, an oxidative treatment during the leaching process is conducted using the same components used at the agglomeration step. Acid solutions comprise iron (II) or (III) sulfate or iron-oxidizing bacteria as part of the chemical solutions. This describes a pretreatment step; however, it does not utilize chelating agents, which may help address the iron precipitation issue.

Japanese Published Patent Application No. 2007/049992A describes a method using a sulfur-oxidizing bacteria used to remove the sulfur layer from leaching-resistant ores such as Cpy. The method is dependent on the bio-oxidation capabilities of the bacteria strain over the passive layer formed. However, this process does not resolve the dissolution of jarosites, and ferric oxides precipitated in the heap.

U.S. Patent Application Publication No. 2023/0086259 describes a method and system for recovering metal value from metal-containing materials. The document outlines a solution for ore agglomeration comprising raffinate and hydrogen peroxide. Moreover, the agglomerated ore is subjected to leaching using an aqueous solution comprising raffinate and citric acid. This process results in the recovery of the copper from the pregnant leaching solution in the heap. The use of hydrogen peroxide and citric acid elevates the temperature at the agglomeration stage, which regulates the precipitation of iron. However, the iron removal strategy used in this process cannot be applied to a broad pH range or in the presence of fluctuating operational parameters on the heap. Also, the solution is used in the agglomeration step only.

In this context, the inventors herein have developed a process for the chemical resetting of copper ore aimed at eliminating residual passivating species on the ore surface, which can be performed between two leaching steps or prior to a leaching step with high efficiency and minimal environmental impact. This process offers a scalable solution for commercial heaps and can be integrated with existing industrial processes.

SUMMARY OF THE INVENTION

The present invention addresses the need for an effective leaching process from refractory ores such as Cpy for copper recovery in the hydrometallurgical field. The invention aims to increase copper recovery by eliminating and dissolving the chemically undesirable species that cause passivation.

In one aspect, the invention is a method to improve recovery of copper from copper ore-containing material, comprising: providing a heap of copper ore previously leached; performing a reset step, wherein the heap of copper ore previously leached is irrigated with a reset solution comprising a chelating agent and a reducing agent, and performing a leaching step, wherein the irrigated heap from the reset step is further treated with a leaching solution comprising acid and a leaching agent to obtain a copper-rich Pregnant Leaching Solution (PLS).

In embodiments, the reset step and the leaching step may be repeated cyclically.

The copper ore provided may comprise copper oxides, primary copper sulfides, secondary copper sulfides, or a mixture thereof. In embodiments, the ore is primarily copper sulfides. In still other embodiments, the ore is primarily chalcopyrite. The leaching solution may be any type, including acid-based, halide-based, chloride-based, nitrate-based or others.

The method may include, prior to the reset step, crushing native copper ore; agglomerating and curing the crushed copper ore to form agglomerated ore; stacking the agglomerated ore to form a heap; and performing a leaching step on the heap, prior to the reset step.

Gases produced in the agglomerating and/or curing may be treated in a gas scrubber.

In embodiments, the reset solution used in the reset step has a redox potential in a range of 200 to 700 mV (vs NHE), and a pH in a range 2 to 6. The chelating agent in the reset solution may be selected from the group consisting of citric acid, lactic acid, tartaric acid, ascorbic acid, salicylic acid, tetrasodium glutamate diacetate acid, ethylenediaminetetraacetic acid, pyruvic acid, succinic acid, aspartic acid, gallic acid, fumaric acid, malic acid, gluconic acid, their conjugate bases, or a mixture thereof; the reducing agent in the reset solution may be a reagent selected from the group consisting of bisulfite ion, dithionite ion, metabisulfite ion, and a mixture thereof; a ratio of the chelating agent and the reducing agent in the reset solution on a molar basis, may be between 4:1 to 1:100; and the reducing agent concentration in the reset solution may be between 10 to 1000 mM.

In embodiments, the chelating agent in the reset solution comprises one or more siderophore selected from the group consisting of hydroxamates, catecholates, carboxylates or a mixture thereof, and may further comprise nicotinamide, amino acids, enterobactin, ferrichrome, ferrioxamine B, E, G, ferrioxamine D1 to D12, or a mixture thereof.

The siderophore may also comprise bio-derived molecules from an improved, optimized and/or genetically modified microorganism.

In embodiments, a reset pregnant solution (RPS) is recovered from the heap during the reset step, and the RPS may be treated to obtain a copper-depleted reset solution which is circulated to the reset solution, and a copper-enriched containing solution. The concentration of copper in the RPS recovered during the reset step, in the copper depleted reset solution and in the copper-enriched containing solution obtained through the treatment of the RPS may be in a range of 8 to 65 mM, below 8 mM and above 30 mM respectively. Treatment of the RPS may comprise physical separation techniques, solid-liquid extraction, liquid-liquid extraction, reverse/forward osmosis, electrocoagulation, electrodialysis, chemical precipitation or a combination thereof.

The method may further comprise a recovery step, wherein soluble copper is recovered from the copper-rich PLS, from the copper-enriched containing solution recovered from treatment of the RPS, or both.

Raffinate obtained from solvent extraction/electrowinning of the PLS may be recirculated to the reset solution, to the leaching solution, or both.

Prior to performing a reset step, the heap may be irrigated with a conditioning solution having a pH in a range of 3.5 to 14. The conditioning solution may comprise a buffering agent. The buffering agent in the conditioning solution may be selected from the group consisting of citric acid, lactic acid, tartaric acid, ascorbic acid, salicylic acid, tetrasodium glutamate diacetate acid, ethylenediaminetetraacetic acid, pyruvic acid, succinic acid, aspartic acid, gallic acid, fumaric acid, malic acid, their conjugate bases, and a mixture thereof. The buffering agent in the conditioning solution may be present in a concentration above 50 mM. In embodiments, the conditioning solution contains less than 0.1 mM of a reducing agent. The conditioning step may be conducted up to the point at which the heap reaches a pH of at least 2.

In embodiments, the conditioning step, the reset step, and the leaching step may be cyclically repeated.

In another aspect, the invention is embodied as a reset solution for performing a reset of copper ore, the reset solution comprising: a chelating agent selected from the group consisting of citric acid, lactic acid, tartaric acid, ascorbic acid, salicylic acid, tetrasodium glutamate diacetate acid, ethylenediaminetetraacetic acid, pyruvic acid, succinic acid, aspartic acid, gallic acid, fumaric acid, malic acid, gluconic acid, nicotinamide, amino acids, enterobactin, ferrichrome, ferrioxamine B, E, G, ferrioxamine D1 to D12, their conjugate bases, and a mixture thereof; and a reducing agent selected from the group consisting of bisulfite ion, thiosulfate ion, dithionite ion, metabisulfite ion, and a mixture thereof. In embodiments, the reducing agent concentration in the reset solution is between 10 to 1000 mM, and a ratio of the chelating agent to the reducing agent, on a molar basis, is between 4:1 to 1:100.

A system for the recovery of copper from copper ore according to the invention may comprise: a first heap of copper ore; a first system of one or more ponds having inputs comprising a chelating agent and a reducing agent; and as output, a reset solution; a second system of one or more ponds having inputs comprising sulfuric acid, a leaching agent, and water; and as output, a leaching solution; a system of one or more ILS ponds having as input the ILS, and as output, ILS to be used in one or more other process stages; a system of one or more PLS ponds having as input the PLS and as output, PLS to be used in one or more other process stages; first piping to provide the reset solution from the first system of one or more ponds to the first heap; second piping to remove reset pregnant solution (RPS) from the first heap; a system of one or more treatment tanks having as input the reset pregnant solution (RPS) and, as output, copper depleted reset solution; third piping to provide the leaching solution from the second system of one or more ponds to a second heap of copper ore, the second heap having, as input, the first heap subjected to reset treatment; fourth piping to provide intermediate leaching solution (ILS) to the second heap of copper ore; and fifth piping to remove ILS or PLS from the leached second heap; a solvent extraction/electrowinning (SX/EW) loop having, as input, the PLS from the PLS pond, and as outputs, raffinate and a copper product. In the foregoing the "second heap" merely refers to the first heap after it has been subjected to treatment with the reset solution.

The system may further comprise a crusher adapted to provide crushed copper ore particles to the first and/or second heap.

The system may further comprise at least one agglomeration drum having an inlet for the leaching solution, whereby crushed copper ore particles provided from the crusher are agglomerated with the leaching solution prior to providing crushed, agglomerated particles to the first and/or second heap.

The system may further an impermeable leach pad at the base of the first and second heap of copper ore.

The system may further comprise at least one leaching-related microbial biomass unit having an inlet for nutrients and/or chemical substrates source, an inlet for microorganisms inoculum; and, as output, leaching-related biomass.

The system may further comprise at least one gas scrubber near the agglomeration drum, having an inlet for the gas produced by the agglomeration drum; and, as output, treated gas.

In the system, the first system of one or more ponds may further comprise inlet piping to provide water replenishment; and at least one of dissolved chelating agents; dissolved reducing agents; a portion of the copper depleted reset solution from the treatment tank, a portion of raffinate solution from the leached heap, or a mixture thereof.

The second system of one or more ponds may further comprise inlet piping to provide water replenishment, and at least one of sulfuric acid, a leaching agent, a portion of a raffinate solution from the leached heap, a portion of ILS from one or more ILS ponds, a leaching-related biomass, or a mixture thereof.

The system of one or more treatment tanks may further comprise, as output, copper-enriched containing solution.

The system may further comprise a sixth piping to provide copper-enriched solution from the one or more treatment tanks to the PLS pond.

BRIEF DESCRIPTION OF THE DRAWINGS

In order for the present invention to be better understood and for its practical applications to be appreciated, the following Figures are provided and referenced hereinafter. It should be noted that the Figures are given as examples only and in no way limit the scope of the invention. Like components are denoted by reference numerals.

DETAILED DESCRIPTION OF THE INVENTION

Figure 1:
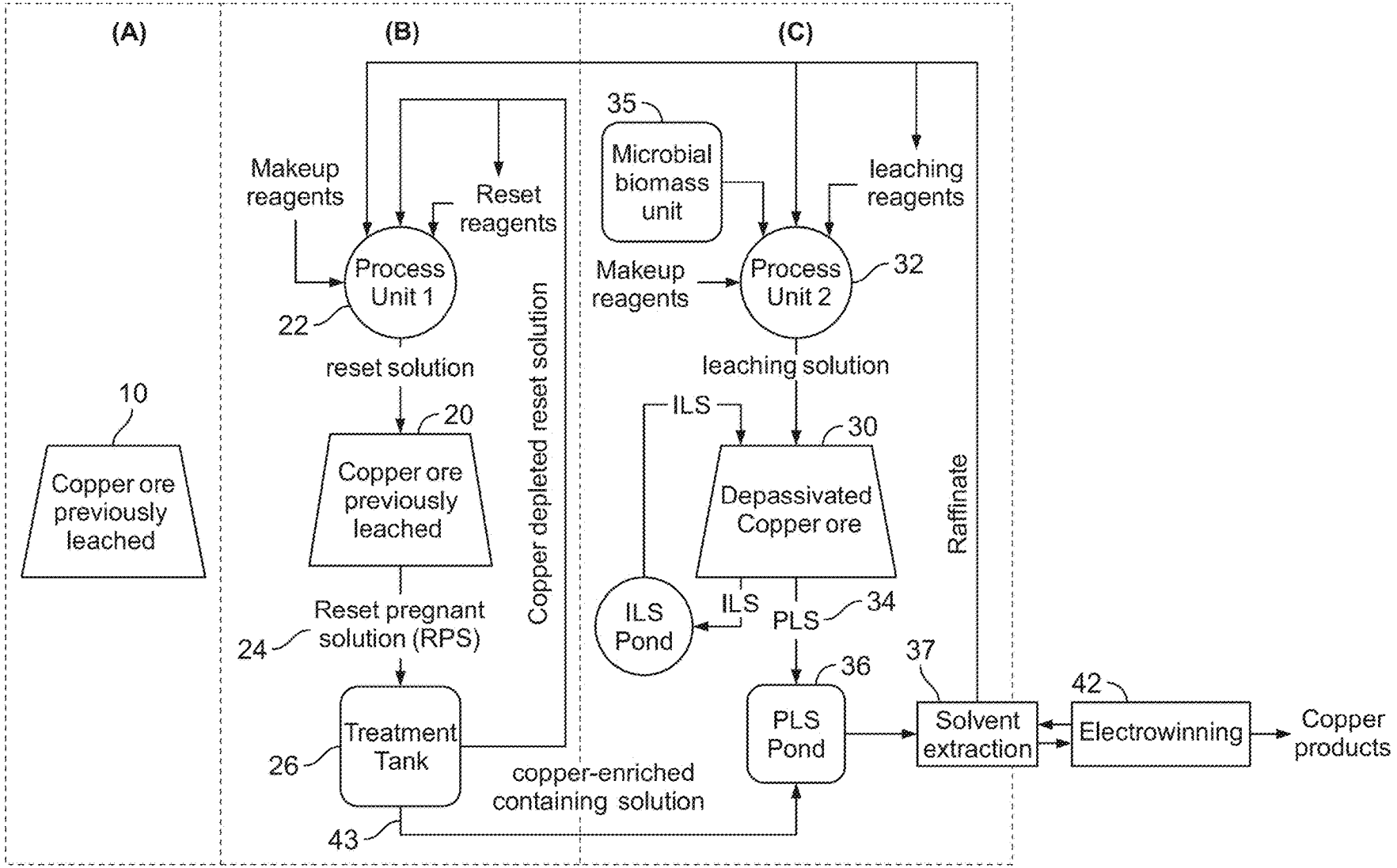
FIG. 1 schematically depicts an overview of the process according to embodiments of the invention.

The following detailed description is provided to facilitate comprehension of the invention. However, it should be noted that the invention can be practiced without specific details. In other instances, known methods, procedures, components, modules, units, and/or circuits have not been described in detail so as to avoid obscuring the invention.

The disclosure herein pertains to a method that is performed on a heap of copper ore that has undergone prior leaching. This method is applied prior to a subsequent leaching process. It may be applicable for the recovery of copper from copper oxide ores, copper sulfide ores, including copper sulfide species that are rich in chalcopyrite, as well other sulfide species, such as enargite and bornite, and/or secondary copper sulfide ores, such as chalcocite-digenite and covellite. The term "copper ore" is understood broadly to refer to ore containing material and may refer to ore that has been previously agglomerated and cured, or un-treated such as mine tailings, run-of mine (ROM), crushed ore or "native ore" that has not been leached. As used herein "inputs" broadly refers to any reagent, ore-containing material or other process component conveyed to a process stage, however the component is conveyed.

In embodiments, copper ore is defined as "primarily" copper sulfide if the copper-containing species in the native ore comprise more than 50% by weight of primary and secondary copper sulfide species. Likewise, an ore is considered "primarily" chalcopyrite if more than 50% of the copper is contained in chalcopyrite. It should be noted that any native ore typically comprises more than one species of copper mineral.

The term "heap" is used to describe any material containing copper ore at any stage of the process, following stacking. A heap may be defined as a pile or stack of crushed ore, often agglomerated with acid. For example, a "heap" may have a flat top surface area of 0.1-1 $km^2$, and a height of 7 m. It should be noted, however, that these dimensions are merely indicative and do not limit the invention in any way. A heap may be modelled using one or more columns of copper ore-containing material in order to approximate reaction times and kinetics. Therefore, as used herein, the term "heap" encompasses such a column. Additionally, a heap may also refer to Run-of-Mine (ROM) material stacked on a leach pad without prior crushing and agglomeration.

The term "irrigation rate" is the volume applied of solution which may be reset solution or leaching solution applied over a specific area of the heap during a period of time and the area refers to the surface are at the top of the heap, or in the case of a column, an equivalent area. It is given in units of $L/h \cdot m^2$.

A "leaching agent" as used herein is a chemical or biological agent used in a leaching solution to facilitate solubilization of copper from copper ore and includes any leaching agent known in the prior art to be used for that purpose in acid solution.

The approach to chemically resetting ores disclosed herein involves modifying the operational parameters (e.g., pH, oxidation-reduction potential (ORP), temperature) and solutions applied to the heap. The resetting process achieves its technical effect by chemically removing the passivated layer present on the surface of the mineral particles, exposing the previously hindered surface to be further leached. Through these means, a greater copper recovery from the resulting depassivated mineral in the subsequent leaching stage is achieved.

The phenomenon of surface passivation is observed in copper sulfides derived during leaching or bioleaching processes at the industrial scale. The formation of this passivating coating is attributed to the deposition of chemical products, including elemental sulfur, polysulfides, jarosites, and iron hydroxy compounds, which are the byproducts of the sulfide ore dissolution. The coating obstructs the free diffusion of reagents across the ore surface, thus reducing the kinetics of copper extraction. In bioleaching processes, the growth of microbial communities attached to the surfaces of the mineral particles, simultaneously with a precipitation of ferric ion as jarosites or hydrated ferric oxides in the EPS membranes, generate a passivating layer on the surface of the ore, hindering further copper extraction.

During heap leaching, the physiochemical conditions within the heap along the process change based on the solutions employed and on the chemical reactions occurring during the copper sulfide dissolution. In the context of Cpy-rich ore dissolution, pH and ORP fluctuate, resulting in over saturation and precipitation of certain compounds on the surface of the ore.

Embodiments of the invention comprise a preliminary stage of leaching, during which the pH and ORP are subjected to operational control involving observation and control of the molar ratio of the pair of iron ions [$Fe^{3+}$: $Fe^{2+}$], and the copper and iron ions [$Cu^{2+}$: $Fe^{3+}$] present in the leaching solution together with the subsequent monitoring of copper extraction kinetic curve. Such periodic monitoring may facilitate the identification of an inflection point at which the subsequent reset stage may be initiated. In embodiments, the inflection point is the minimum copper extraction rate within a range of 0.1 to 0.2% of copper per day per ton of total copper available in the ore.

Alternatively in non-limiting embodiments, the initial leaching process may be performed in three distinct zones of the ratio ORP/pH: (1) In a reductive zone with a majority of ferrous ($Fe^{2+}$) and cupric ions ($Cu^{2+}$), with a pH range between 0 and 2 and an ORP range of 200 to 350 mV vs.

SHE, as measured at the irrigation solution and the output solution or PLS; (2) in a non-oxidative zone of pH/ORP, the pH levels in a range from 0 to 2, while the ORP levels fluctuate between 400 and 670 mV vs. SHE, and (3) an oxidative zone delineated by a pH range of 0 to 2 and an ORP range of 750 to 800 mV vs. SHE. In further embodiments, this leaching process includes, without limitation, chloride, halide, nitrate or bioleaching.

The reset step, as described in embodiments of the invention, involves the treatment of the ore with a specific reset solution. In one aspect of the invention, the reset solution comprises a chelating agent and a reducing agent. In other embodiments, the reset solution is effective in removing the passive layer that has formed on the surfaces and in the micropores or microchannels of the ore particles, which are primarily composed of jarosite, elemental sulfur and Fe(III)-EPS deposits. In yet another aspect of the invention, the reset solution also contains a sulfur-oxidizing microorganism. In certain embodiments, the reducing agent in the reset solution is an iron-reducer microorganism. In certain embodiments, the treatment of the ore with the reset solution during the reset step produces a Reset pregnant solution (RPS) 24 obtained from the heap.

A "reducing agent" as used herein is a chemical or biological agent capable of reducing ferric ions ($Fe^{3+}$) to ferrous ions ($Fe^{2+}$) in the reset solution and acting on the ferric ions as an electron receptor. Specifically, this chemical reduction is facilitated for example by the bisulfite ion ($HSO_3^-$). Ferric ions are present in the ferric precipitates, including hydroxides and jarosites, which form the passivation layer on the ore. The process of elemental sulfur ($S^0$) conversion to thiosulfate, which ultimately results in sulfate formation, is also a consequence of the effect of the reducing agent in the reset solution in this resetting step. In some embodiments, the reduction of ferric ions present in the precipitates as jarosite, ferrihydrite or ferric hydrate oxide is facilitated by reducing agents such as bisulfite ions, metal bisulfite or dithionite anions, resulting in the liberation of ferrous ions. These reductive reactions are activated synergistically by the immediate and rapid coordination or complexation of Fe(III) and Fe(II) by chelating agents and/or siderophores present in the reset solution. This transport of the precipitated iron passivating the mineral occurs efficiently. These reductions of ferric precipitates occur according to the following chemical reactions:

Ferric reductions by bisulfite $HSO_3^-$ in acid solutions:

$$HSO_3^-{}_{(aq)} + 2\,Fe^{3+}{}_{(aq)} + H_2O \longrightarrow 2\,Fe^{2+}{}_{(aq)} + SO4^{2-}{}_{(aq)} + 3\,H^+{}_{(aq)} \quad (1)$$

In other embodiments of the invention, elemental sulfur ($S^0$) is reduced by bisulfite ions. The process contemplates the depassivation of the sulfur deposited on the copper sulfide mineral by different reductive reactions under a complex chain mechanism, until its complete conversion to $H_2SO_4$, following the set of general equations:

$$S^0{}_{(s)} + HSO_3^-{}_{(aq)} \longrightarrow S_2O_3^{2-}{}_{(aq)} + H^+{}_{(aq)} \quad (2)$$

The chemical reactions entail the conversion of the passivation elemental sulfur ($S_0$) on the surface of the chalcopyrite to hydrogen sulfide or hydrogen polysulfide. Subsequently, a conversion of $H_2S$ and $H_2S_n$ (generated in this reductive environment) to thiosalts (with the general formula of $S_xO_y^{2-}$) occurs, including thiosulfates, dithionates and trithionates. The resulting chemical compounds can be subsequently oxidized to sulfates, thereby eliminating the elemental sulfur (in its forms of $S^0$ or S8) coating on the chalcopyrite particle.

As used herein, a "chelating agent" is a chemical or biological agent that facilitates mobilization of metals, including, without limitation, ferric, ferrous, cupric, and cuprous ions at the interface between the ore and the leaching and/or reset solution. This facilitates the removal of these impurities from the heap in further irrigation steps. In conjunction with the reducing agent, a solution is formed that is capable of solubilizing and mobilizing a variable precipitate, including calcium, magnesium, silica, and other species contained in the ore.

In embodiments, the chelating agent may be or may include one or more siderophores, which are small and high-affinity iron-chelating compounds produced by microorganisms. Siderophores bind to ferric iron ($Fe^{3+}$) with specificity, forming and transporting soluble iron-siderophore complexes. When in complex with the siderophore, the iron ions may be removed and solubilized from the surface of the ore. The chemical structure of the siderophores may include multiple functional groups capable of coordinating iron. These structures, without limitation, contain ligands like hydroxamates, catecholates and carboxylates which form stable complexes with iron through multidentate interactions forming an octahedral complex such as disclosed in Hider & Kong, "*Natural product reports*" 27.5 (2010): 637-657. In embodiments, a chelating agent in the reset solution is selected from the group consisting of citric acid, lactic acid, tartaric acid, ascorbic acid, salicylic acid, tetrasodium glutamate diacetate acid, ethylenediaminetetraacetic acid, pyruvic acid, succinic acid, aspartic acid, gallic acid, fumaric acid, malic acid, gluconic acid, their conjugate bases, or a mixture thereof. In further embodiments, the siderophore in the rest solution is selected from the group consisting of hydroxamates, catecholates, carboxylates or a mixture thereof. In further embodiments, the siderophore in the reset solution comprises nicotinamide, amino acids, enterobactin, ferrichrome, ferrioxamine B, E, G, ferrioxamine D1 to D12, or a mixture thereof. In further embodiments, the siderophore in the reset solution comprises bio-derived molecules from an improved, optimized and/or genetically modified microorganism.

In some embodiments, chelating agents such as Ethylenediaminetetraacetic acid (EDTA) form coordinating chemical structures with the iron ions, rendering them soluble in aqueous solutions (aq) according to the following general equation:

$$Fe^{3+} + EDTA^{4-}{}_{(aq)} \rightleftharpoons [Fe(EDTA)]^-{}_{(aq)} \quad (3)$$

In another embodiment of the invention, the chemical complex formed between iron and citrate in an acidic aqueous solution works as the following general equations:

$$Fe^{3+}{}_{(aq)} + HCit^{-2}{}_{(aq)} \rightleftharpoons FeHCit^+{}_{(aq)} \quad (4)$$

-continued

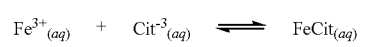

$$Fe^{3+}_{(aq)} + Cit^{-3}_{(aq)} \rightleftharpoons FeCit_{(aq)} \quad (5)$$

In addition to citrate and EDTA, other chelating agents may be used. In embodiments, the complexation of $Fe^{3+}$ and the chelating agent tetrasodium glutamate diacetate acid (GLDA) is in accordance with the following general equations:

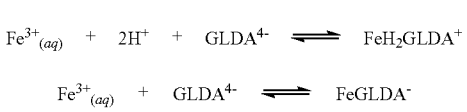

$$Fe^{3+}_{(aq)} + 2H^{+} + GLDA^{4-} \rightleftharpoons FeH_2GLDA^{+} \quad (6)$$

$$Fe^{3+}_{(aq)} + GLDA^{4-} \rightleftharpoons FeGLDA^{-} \quad (7)$$

As depicted in FIG. 1, in accordance with an exemplary embodiment of the present invention, the method may comprise three steps (A), (B) and (C) conducted in order. Additionally, processing may occur between these three steps. The initial step (A) involves providing a heap of previously leached copper ore 10. In the second step (B), the heap is treated with a reset solution 20 in reducing conditions. The third step (C) involves subjecting the ore to a leaching process. Thus, the reset step is separated from prior or subsequent leaching processes. As depicted in FIG. 1, reset solution may be processed in and provided from process unit 1, 22 including one or more mixing tanks receiving make-up reagents and reset reagents to formulate and reconstitute the reset solution, and leaching solution may be processed in and provided from process unit 2, 32 including one or more mixing tanks receiving make-up reagents and leaching reagents to formulate and reconstitute the reset solution. This allows for control of copper ore resetting through the adjustment of process variables, including pH and redox potential. Furthermore, this process enables more effective treatment of insoluble species, such as ferric-derived ions or elemental sulfur ($S_0$). Finally, the resetting step prevents unintended chemical reactions between the reset solution and the leaching solution, which may result in the production of undesirable by-products and potentially affect the effectiveness of the reset treatment.

The ore may be subjected to a process of crushing, agglomeration and curing, as described in detail below or as described in the prior art. For example, in some embodiments, the ore may be crushed to a $P_{100}$ particle size prior to forming the heap. This may entail a particle size distribution in which 100 percent of particles are less than 1 inch, with a range between about ½ inch to about 1 inch. It is preferable that the ore be crushed prior to the agglomeration step, which is performed before the leaching step and/or the reset step. Crushing involves a mechanical reduction of the ore size. In some embodiments, this reduction is to a range wherein 100% of the particles are smaller than ¼ inch (at one end of the range) and up to 100% of the particles are smaller than ¾ inch (at the upper end of the range). In conventional stockpile operations, agglomeration is conducted as a subsequent step following crushing and prior to stockpiling. This involves the application of a concentrated mixture of sulfuric acid, water, and/or raffinate (derived from the solvent extraction (SX) stage) to the mineral.

In some embodiments, the agglomeration step may be conducted subsequent to the additional crushing step. This step involves the mechanical fractioning of the ore, with the objective of increasing its surface area. In some embodiments, the agglomeration step comprises wetting and adding concentrated sulfuric acid, which facilitates the adhesion of the fine particle fraction to larger particles. This process generates hydraulically and mechanically stable ore agglomerates. The ore wetting may be performed while the ore is being agglomerated, in an agglomeration drum or using other wetting systems. In some embodiments, gases produced in the agglomerating and curing steps may be treated in a gas scrubber to remove undesirable chemical species. Subsequently, an additional step of agglomerated ore stacking may comprise the transportation of the agglomerated ore from the additional agglomeration step to the leach heap via conveyor belts.

As an alternative, the ore may be wetted during ore stacking. The wetting of the ore, in the additional stacking step, may be carried out on conveyor belts that transport the ore to the leach heap, or by another equivalent method, depending on the loading procedures employed.

As an alternative, the ore may be stacked and leached (without being crushed and agglomerated previously) in large leach pads, as described in the art.

In accordance with an embodiment of the invention, the heap of copper ore is subjected to any of the processes described in the art for leaching copper from copper containing material comprising copper sulfides to provide ore previously leached. Prior to the reset step, the heap may undergo a leaching step (C) using sulfuric acid, solutions comprising ferric ions, chloride ions, or nitrate ions; copper-depleted raffinate; microorganisms; or a combination of these. In embodiments, the leaching step produces a pregnant leaching solution (PLS) 34.

In further embodiments, a reset pregnant solution (RPS) is recovered from the heap during the reset step. In some embodiments, the RPS is treated to obtain a copper depleted reset solution which is circulated to the reset solution and a copper-enriched containing solution. In further embodiments, the concentration of copper in the RPS recovered during the reset step and in the depleted reset solution and the copper-enriched containing solution obtained through the treatment of said reset pregnant solution is in the range of 8 mM to 65 mM, below 8 mM, and above 30 mM respectively. In further embodiments, the treatment of the RPS comprises physical separation techniques, solid-liquid extraction, liquid-liquid extraction, reverse/forward osmosis, electrocoagulation, electrodialysis, chemical precipitation or a combination thereof. Physical separation techniques aim at separate the components of heterogeneous or homogeneous mixtures without altering their chemical composition and include any method such as settling, decantation, filtration, evaporation, crystallization and centrifugation, or mixtures thereof as described in the art. Solid-liquid extraction separates metals of interest from an aqueous solution by means of a selective solid phase, such as ion exchange, or through any other method described in the art. Liquid-liquid extraction aims at separating metals of interests by using two immiscible or partially immiscible liquids having different solubilities of the metal of interest. Liquid-liquid extraction may be performed through solvent extraction, ionic liquids or through any other such techniques described in the art. Reverse/forward osmosis is able to either concentrate or to separate the metals of interest from an aqueous solution through the use of semi-permeable membranes. Electrocoagulation aims at either concentrating or separating the metals of interest from an aqueous solution by applying an electric current through two electrodes to an electrolytic solution. Chemical precipitation aims to precipitate the metal of interest by applying a chemical agent such as aluminum and iron salts, or others as described in the art. Electrodialysis concentrates and/or separates metals of interest by using electrical electrodes to move ions through semi-permeable membranes. In some embodiments, the RPS is further treated in treatment tank 26, to obtain a copper depleted reset solution and a copper-enriched containing solution. In further embodiments, the copper-enriched containing solution obtained through the treatment of the RPS may be then advanced to PLS pond 36 and processed according to techniques known in the art. Subsequently, the PLS from the PLS pond may be pumped to a solvent extraction (SX) process for the separation and recovery of copper. Subsequently, two streams are produced: a copper-rich electrolyte solution that is advanced to the EW process and a raffinate solution, which is the aqueous phase from the SX. This copper-depleted raffinate may form part of the leaching solution used for heap irrigation. In some embodiments, the average volume of leaching solution irrigated is between 2 and 43 liter per kilogram of ore. However, any volume of leaching solution and leaching protocol known in the art may also be used.

In reference to FIG. 1, the ore at (A) may undergo agglomeration, subsequent transportation to the stockpile formation, and leaching using conventional solutions before the reset solution irrigation (B). Both leaching steps (A) and (C) are conducted until the point at which copper extraction is no longer feasible.

With reference to FIG. 1, the copper ore reset step (B) may involve the irrigation of copper ore with a reset solution comprising a chelating agent and a reducing agent. The molar ratio of the chelating agent to the reducing agent in the reset solution may be within the range of 4:1 to 1:100. The concentration of the reducing agent in the reset solution may be between 10 and 1000 mM. In some embodiments, the chelating agent in the reset solution is selected from the group consisting of citric acid, lactic acid, tartaric acid, ascorbic acid, salicylic acid, tetrasodium glutamate diacetate acid, ethylenediaminetetraacetic acid, pyruvic acid, succinic acid, aspartic acid, gallic acid, fumaric acid, malic acid, gluconic acid, their conjugate bases, or a mixture thereof. The amount of chelating agent used is preferably sufficient to improve iron solubilization. The reset solution used in the reset step has a pH in a range of 2 to 6 and a redox potential ranging from 200 to 700 mV. The reset solution may be formulated in a pond or series of ponds, which receive the reducing agent and the chelating agent as inputs. These inputs may be provided in the form of aqueous solutions, which are held in tanks and pumped through conventional piping. As illustrated in FIG. 1, the term "Process Unit 1" denotes a pond or series of ponds where the reset solution may be formulated. In some embodiments, the reset step produces a reset pregnant solution which is recovered and treated to obtain a copper depleted reset solution which is recirculated to the reset solution, and a copper-enriched containing solution. The reset pregnant solution is derived from a heap that has undergone a reset process and contains copper ore by-products, including copper and iron ions. In some embodiments, the reset pregnant solution has a copper concentration in the range of 8 to 65 mM. In some embodiments, the reset pregnant solution is treated through physical separation techniques, solid-liquid extraction, liquid-liquid extraction, reverse/forward osmosis, electrocoagulation, electrodialysis, chemical precipitation or a combination thereof to obtain a copper depleted reset solution and a copper-enriched containing solution. In further embodiments, the concentration of copper in the copper depleted reset solution and in the copper-enriched containing solution is in the range of below 8 mM and above 30 mM respectively. In some embodiments, the reducing agent in the reset solution is effective for iron solubilization and sulfur conversion. This may include the reduction of $Fe^{3+}$ to $Fe^{2+}$ and the conversion of elemental sulfur to thiosulfate or another chemical species, which generates sulfate in the final stage. The reducing agent in the reset solution may comprise bisulfite ion, dithionite ion, metabisulfite ion, or a mixture of these. In some embodiments, prior to performing the reset step, the heap is irrigated with a conditioning solution having a pH in a range of 3.5 to 14 in a "conditioning" step. In further embodiments, the conditioning solution in the conditioning step comprises a buffering agent. In other embodiments, the conditioning solution in the conditioning step further comprises raffinate. In further embodiments, the buffering agent of the conditioning solution is selected from the group consisting of citric acid, lactic acid, tartaric acid, ascorbic acid, salicylic acid, tetrasodium glutamate diacetate acid, ethylenediaminetetraacetic acid, pyruvic acid, succinic acid, aspartic acid, gallic acid, fumaric acid, malic acid, their conjugate bases, and a mixture thereof. In other embodiments, the concentration of the buffering agent in the conditioning solution is above 50 mM. In further embodiments, the conditioning solution comprises a reducing agent in a concentration less than 0.1 mM. The conditioning step is conducted up to the point in which the heap reaches at least a pH of 3.5. This allows for buffering the reset solution at the heap in a range of pH between 3.5 to 14. The buffering effect minimizes the risk of the generation of sulfur oxides ($SO_x$) gases during the readjustment step and to remove salts or other residues from the previous leaching step.

In other embodiments, the sulfur-oxidizing microorganism for elemental sulfur solubilization may be selected from the genera *Acidithiobacillus, Acidiphilium, Acidicaldus, Acidiferrobacter, Acidihalobacter, Alicyclobacillus, Sulfobacillus, Hydrogenobaculum, Acidithiomicrobium*, and mixtures thereof.

In embodiments of the invention, the reset step is executed within a time frame of between 10 and 40 days. In embodiments, the reset solution is irrigated at a ratio of between 0.1 and 8 liters of reset solution per kilogram of ore.

Following the reset step, a subsequent stage of leaching may be initiated, whereby the heap may be irrigated with a variety of solutions, including sulfuric acid, solutions comprising ferric ions, chloride ions, or nitrate ions, copper-depleted raffinate, microorganisms, and mixtures thereof. The reset process of the present invention may be adapted to different leaching processes and will enhance copper recovery regardless of the leaching technology employed. The "Process Unit 2" denotes a pond or a series of ponds in which a leaching solution may be formulated and receives inputs such as the microorganisms from the microbial biomass process unit 35 (if necessary), and/or copper-depleted raffinate and other reagents from a leaching reagents process unit. In further embodiments, the reset solution and the leaching steps can be repeated cyclically over the passivated copper ore. Piping may be provided to remove ILS or PLS from the leached second heap.

In some embodiments, the leaching irrigation step over the copper-ore containing material produces a pregnant leaching solution (PLS) that may be advanced to the PLS pond and subsequently processed according to techniques that are well known in the art. Subsequently, the PLS from the PLS pond is pumped to a solvent extraction (SX) process 37 for the separation and recovery of copper. Subsequently, two streams are produced: a copper-rich electrolyte solution that is advanced to the electrowinning (EW) process 42 and a raffinate solution, which is the aqueous phase from the solvent extraction (SX) process. This copper-depleted raffinate may form part of the leaching solution. In some embodiments, the average volume of leaching solution irrigated is between 2 and 4 liters per kilogram of ore. However, any volume of leaching solution and leaching protocol known in the art may also be used.

In another aspect of the invention, the microorganism component of the reset solution and the microorganism component of the leaching solution are produced through biomass augmentation for use in the reset step or in the leaching step over the copper ore. With reference to FIG. 1, the microorganism component of the leaching solutions is produced in the microbial biomass process unit 35.

The "microbial biomass process unit" denotes a biomass platform comprising at least one bioreactor with an inlet for nutrient and/or chemical substance sources, an inlet for microbial inoculum, and an output of reset-related biomass (to provide sulfur-oxidizing or iron reducer microorganisms to the reset solution) or leaching-related biomass (to provide bioleaching microorganisms to the leaching solution).

In other embodiments, the invention is a method to generate acid comprising a) providing ore comprising sulfur; (b) treating said ore with a releasing solution comprising a releasing agent and; c) collecting the acid of the bottom of the ore. In further embodiments, the releasing agent in the releasing solution is selected from the group consisting of chelating agents and/or reducing agents. In further embodiments, the chelating agents in the releasing solution are citric acid, lactic acid, tartaric acid, ascorbic acid, salicylic acid, tetrasodium glutamate diacetate acid, ethylenediaminetetraacetic acid, pyruvic acid, succinic acid, aspartic acid, gallic acid, fumaric acid, malic acid, or a mixture thereof. In further embodiments, the reducing agents in the releasing solution are bisulfite ion, dithionite ion, metabisulfite ion, and a mixture thereof. In further embodiments, the acid thusly collected is recirculated into a heap to be used to further leaching. In other embodiments, the acid thusly collected is treated in a treatment tank previous to its recirculation into a heap. In further embodiments, the acid thusly collected is redirected and used in a different industrial process.

In other embodiments, the invention is a method for generating acidified conditions on a heap of ore comprising a) providing ore comprising sulfur and (b) treating said ore with a releasing solution comprising a releasing agent. In further embodiments, the releasing agent in the releasing solution is selected from the group consisting of chelating agents and/or reducing agents. In further embodiments, the chelating agents in the releasing solution are citric acid, lactic acid, tartaric acid, ascorbic acid, salicylic acid, tetrasodium glutamate diacetate acid, ethylenediaminetetraacetic acid, pyruvic acid, succinic acid, aspartic acid, gallic acid, fumaric acid, malic acid, or a mixture thereof. In further embodiments, the reducing agents in the releasing solution are bisulfite ion, dithionite ion, metabisulfite ion, and a mixture thereof.

EXAMPLES

Example 1

In a working example, for the preparation of the reset solution, 969 g of water was poured into a 2 L beaker. Then, with stirring, 4.9 mL of 40% citric acid was added. After its dissolution, 62.4 g of sodium bisulfite was slowly added to the agitated mixture. Stirring was stopped when the bisulfite salt was completely dissolved. The resulting 1 L reset solution contained 600 mM of sodium bisulfite, 10 mM of citric acid, and a pH of 3.2.

Example 2—Iron Removal

Figure 2:
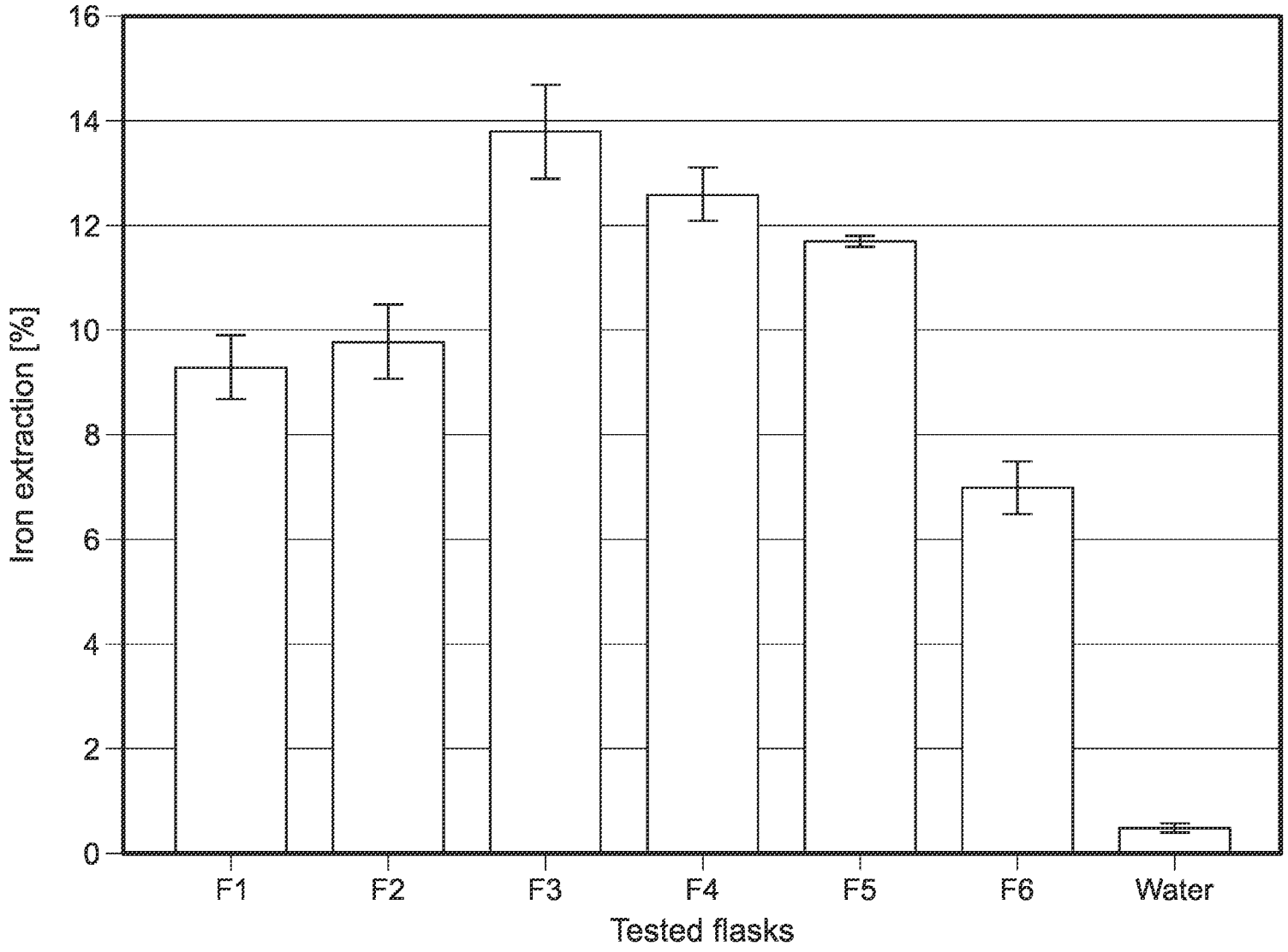
FIG. 2, FIG. 3 and FIG. 4 plot the solubilization of iron species from passivated ore, according to various embodiments of the invention, including comparative examples.
Figure 3:
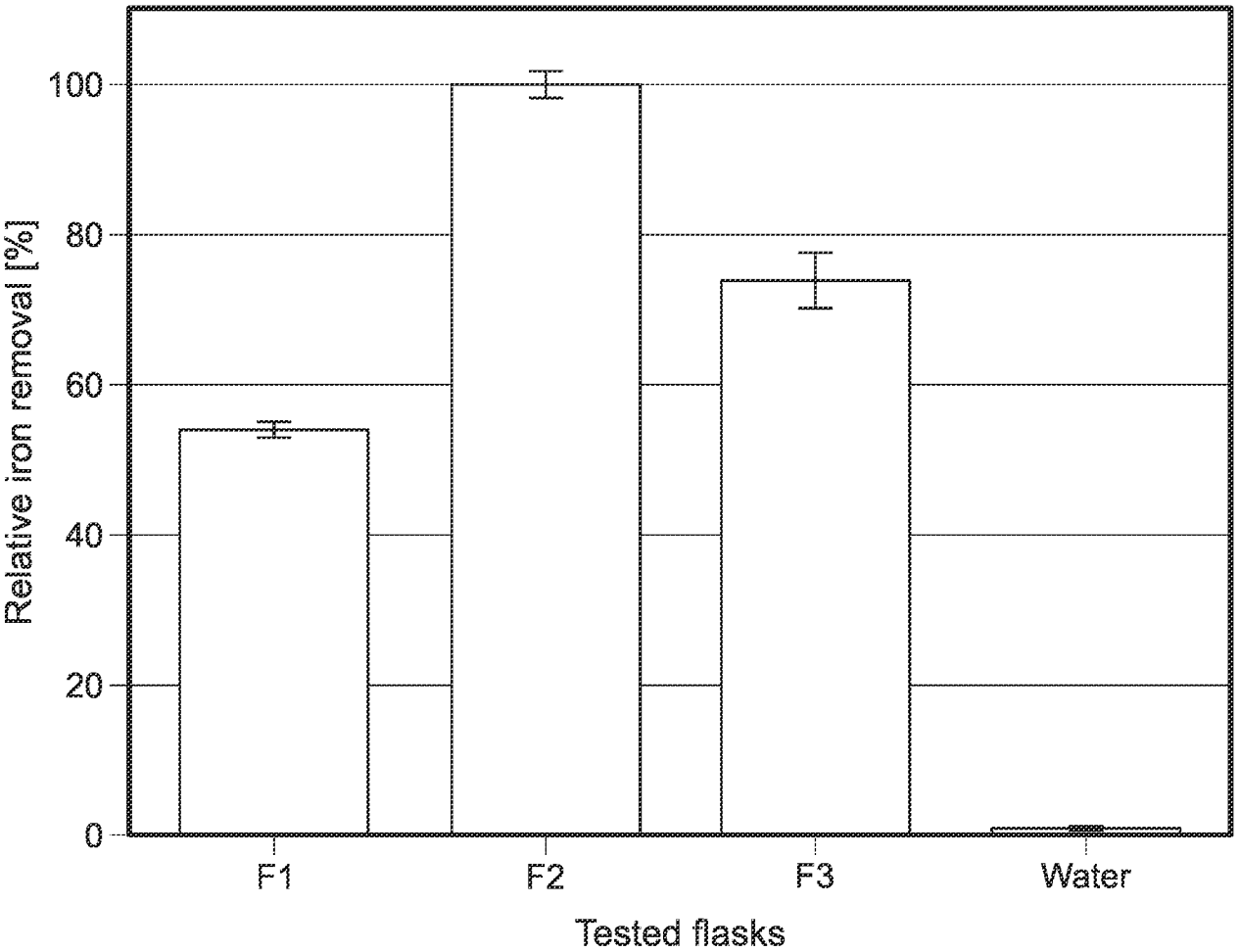
Figure 4:
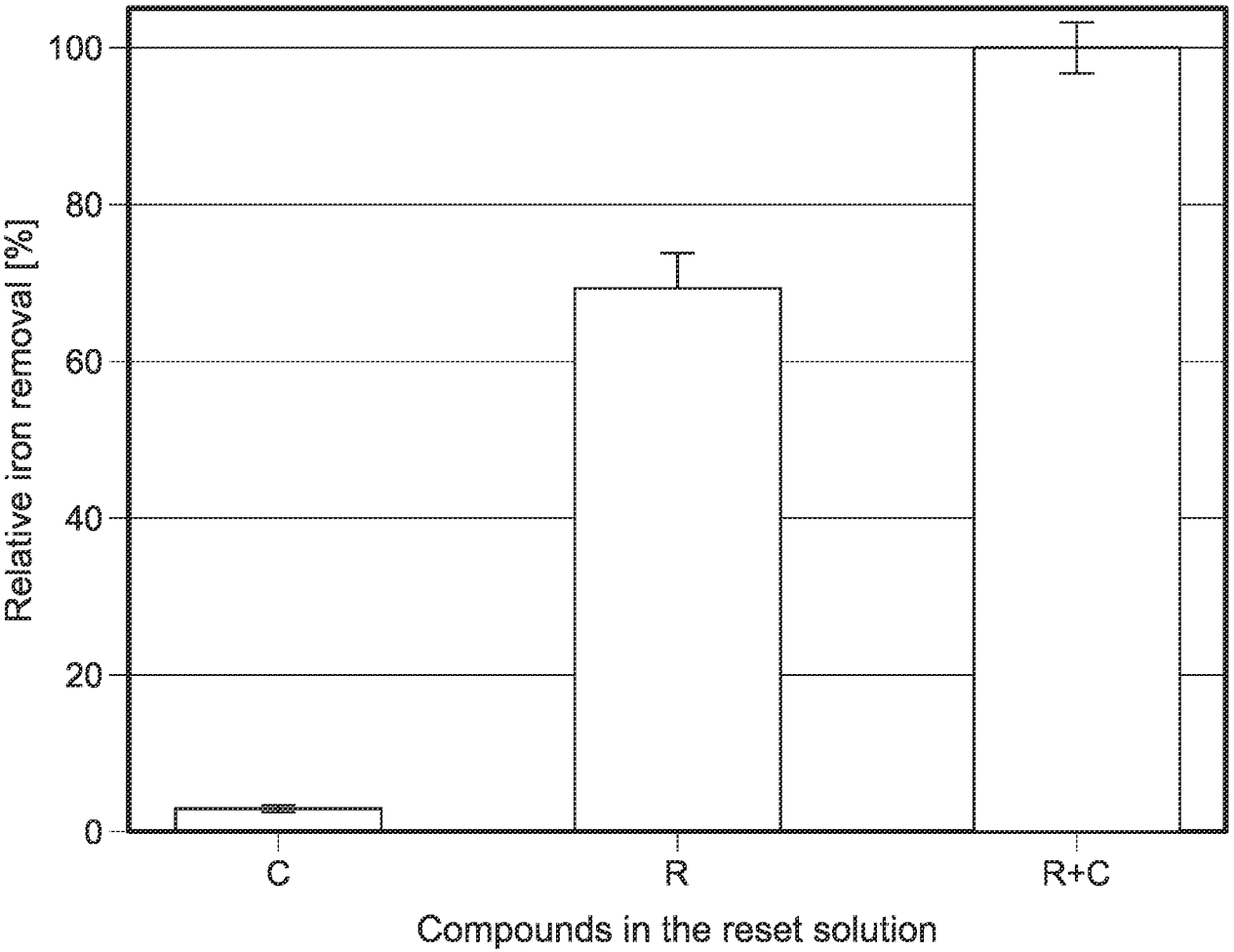

FIGS. 2, 3 and 4 depict the solubilization of iron from passivated copper ore. Copper ore, composed mainly of primary copper sulfide ore (about 84-95% of the contained copper as chalcopyrite), and to a lesser extent, secondary copper sulfide ore (up to 10% of the contained copper as covellite, and up to 10% of the contained ore as a chalcocite/digenite), with an ore size of $P_{80}$0.18 inch, was passivated to facilitate the precipitation of ferrous hydroxides (e.g. jarosite). To passivate the ore, the material was first subjected to a chemical treatment with synthetic raffinate, composed mainly of aluminum, potassium, sodium and iron ions dissolved in diluted sulfuric acid, with a pH less than 1.2, and for 10 days. Subsequently, the treated material was subjected to chemical characterization with XRD to confirm the presence of iron precipitates (about 10% of jarosite).

The effect of the reset solution may be observed as the solubilization of undesirable species, such as iron hydroxy compounds, from the surface of the passivated ore. This allows copper occluded in the ore to be leached subsequently. Following the ore treatment, an increase in iron concentration in the reset solution is expected, which is indicative of the solubilization of iron. The iron extraction is shown based on the total iron in the sample, including the percentage of iron in the ore and the iron precipitates generated during ore passivation.

For FIG. 2, six laboratory flasks were prepared, each containing the same quantity of passivated copper ore. Subsequently, each flask containing the corresponding material was treated with the same volume of each different reset solution described in Table I below. This was done to assess the effect of variants of reducing and chelating agents. Each flask was continuously stirred for 10 days at 30° C. Finally, a sample of the liquid supernatant, along with the residual solids from each flask was collected and the iron content of each sample was determined. For comparison purposes, a flask containing passivated ore treated with water at pH 4.5 was also included (as the water flask in FIG. 2). The iron extraction of each reset solution was calculated as a percentage of the amount of iron extracted from the passivated ore at the end of resetting period of the flask, relative to the total amount of iron presented in the initial ore sample.

TABLE I

Variants of reducing and chelating agents employed in each reset solution

| Flask ID | Reducing agent | Chelating agent | R:C Ratio | pH |
|---|---|---|---|---|
| F1 | Sodium dithionite (0.6M) | Ascorbic acid (0.01M) | 60:1 | 4.5 |
| F2 | Sodium metabisulfite (0.6M) | Ascorbic acid (0.01M) | 60:1 | 4.5 |
| F3 | Sodium metabisulfite (0.6M) | EDTA (0.01M) | 60:1 | 4.5 |

TABLE I-continued

| Variants of reducing and chelating agents employed in each reset solution | | | | |
|---|---|---|---|---|
| Flask ID | Reducing agent | Chelating agent | R:C Ratio | pH |
| F4 | Sodium metabisulfite (0.6M) | GLDA (0.01M) | 60:1 | 4.5 |
| F5 | Sodium bisulfite (0.6M) | Ascorbic acid (0.01M) | 60:1 | 4.5 |
| F6 | Sodium bisulfite (0.6M) | Citric acid (0.01M) | 60:1 | 4.5 |

In a further experiment, and related to FIG. 3, three laboratory flasks were prepared, each containing the same quantity of passivated copper ore. Subsequently, each flask containing the corresponding material was treated with the same volume of each different reset solution described in Table II below. This was done to assess the effect of the reducing-chelating ratio (R: C). Each flask was continuously stirred for 10 days and at 30° C. Finally, a sample of the liquid supernatant, along with the residual solids from each flask were collected and the iron content of each sample was determined. For comparison purposes, a flask containing passivated ore treated with water at pH 4.5 was also included (as the water flask in FIG. 3). The relative iron removal of each reset solution was calculated as a percentage of iron extraction, in comparison to the reset solution with the highest iron removal disclosed herein (R: C ratio of 60:1).

TABLE II

| Reducing-Chelating (R:C) ratios employed in each reset solution | | | | |
|---|---|---|---|---|
| Flask ID | Reducing agent | Chelating agent | R:C Ratio | pH |
| F1 | Sodium dithionite (1M) | Citric acid (0.01M) | 100:1 | 4.5 |
| F2 | Sodium dithionite (0.6M) | Citric acid (0.01M) | 60:1 | 4.5 |
| F3 | Sodium dithionite (0.1M) | Citric acid (0.4M) | 1:4 | 4.5 |

In a further experiment, and related to FIG. 4, three laboratory flasks were prepared, each containing the same quantity of passivated copper ore. Subsequently, each flask containing the corresponding material was treated with the same volume of each different solutions described in Table III below. This was done to assess the combined effect of both reducing and chelating compounds. Each flask was continuously stirred for 10 days at 30° C. Finally, a sample of the liquid supernatant, along with the residual solids from each flask was collected and the iron content of each sample was determined. The iron removal of the reducing and the chelating agent was calculated as a relative iron removal (%), in comparison to the iron removal of the reset solution with both the reducing and chelating agent.

TABLE III

| Synergistic effect of the compound in the reset solution | | | |
|---|---|---|---|
| Flask ID° | Reducing agent | Chelating agent | pH |
| C | — | Citric acid (0.01M) | 4.5 |
| R | Sodium Dithionite (0.6M) | — | 4.5 |
| R + C | Sodium Dithionite (0.6M) | Citric acid (0.01M) | 4.5 |

In the example of FIG. 2, and related to Table I, the iron extraction rate was between 7% and 14%, which was significantly higher than the iron extraction obtained solely with water (approximately 0.5%). The flasks tested the reset solutions with different variants of reducing agents (such as dithionite, bisulfite and metabisulfite) and different variants of chelating agents (such as ascorbic acid, citric acid, EDTA and GLDA) demonstrated comparable iron extraction, confirming the effectiveness of each chemical equivalent that composes the reset solution. It is expected that higher iron removal can be achieved with an extended resetting time and in a continuous irrigation system, which is a feature of any heap ore irrigation process. It is also important to note that the composition of the reset solution used in the Flask N°6 is similar to that used in the leaching column experiment of the Example 3 (0.6 M sodium bisulfite with 10 mM citric acid, pH 4.5).

In the example of FIG. 3, and related to Table II, the efficacy of each reset solution in terms of iron removal is contingent upon the concentration of each the reducing and the chelating agents, as well as the R: C ratio. It is evident in this experiment that the highest iron removal was achieved with a reset solution comprising 0.6 M of reducing agent and 0.01 M of chelating agent (F2). Higher concentrations of reducing agents did not result in improved iron removal (F1). Similarly, low amounts of reducing agents and high amounts of chelating agents also did not result in improved iron removal (F3). These results suggest that intermediate values of R: C ratio, as well as chelating and reducing agent concentration values are necessary for an optimal iron removal and preparation of the depassivated ore for the subsequent leaching step.

In the example of FIG. 4, and related to Table III, using only the chelating (C) or the reducing (R) agent in the reset solution, losses about 30% of the relative iron removal which is obtained when the chelating and reducing agents are used together. This demonstrates a synergistic effect when the compounds in the reset solution are used in combination. Although the chelating agent is typically described as a molecule that can coordinate iron ions, it is expected that, in conjunction with the reducing agent, the chelating agent will gain a new feature that will enhance the iron release from the passivated mineral.

Example 3—Leaching Columns

Figure 5:
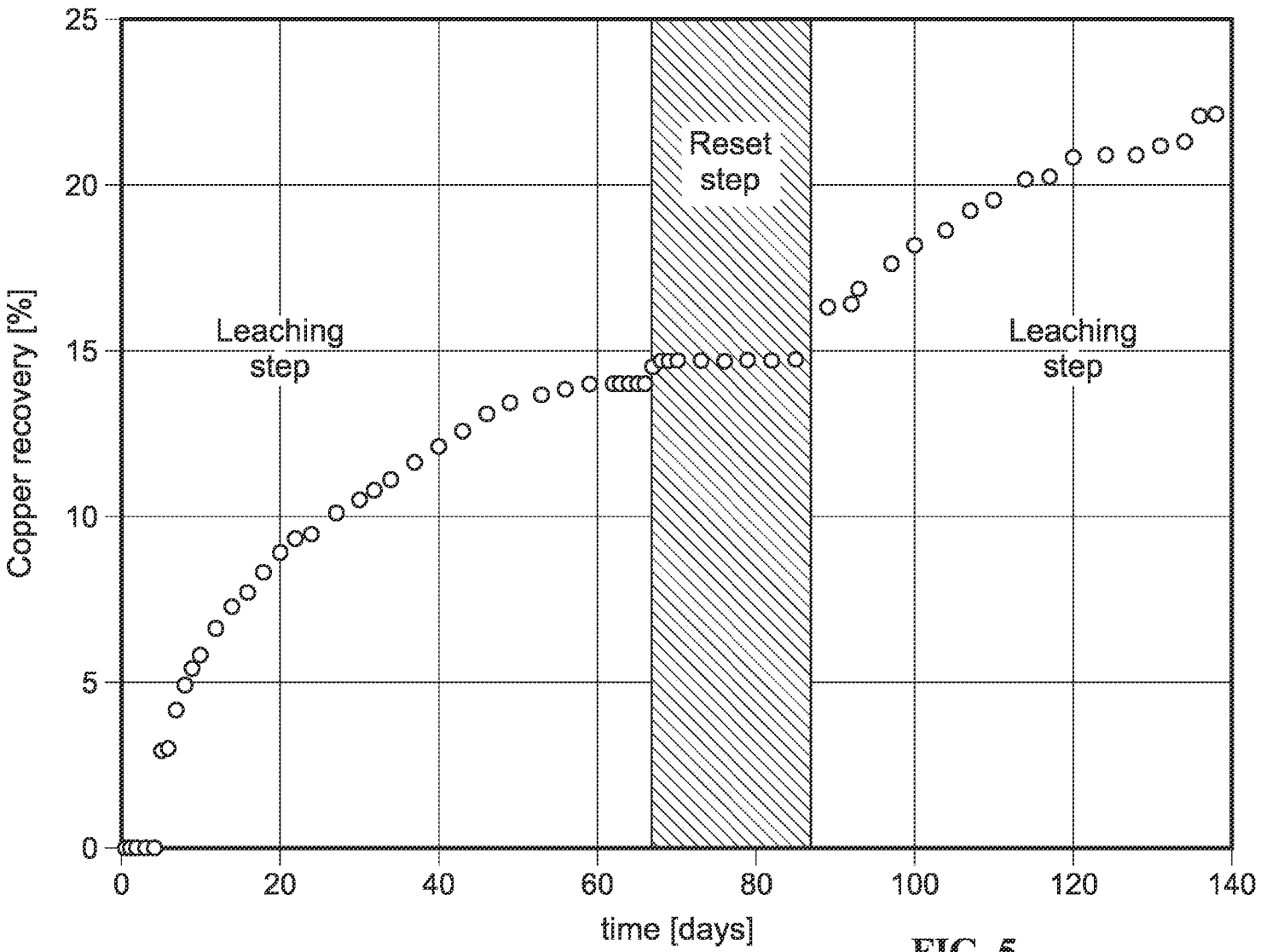
FIG. 5 depicts copper recovery versus time, showing the effect of the reset process on copper recovery according to an embodiment of the invention.
Figure 6:
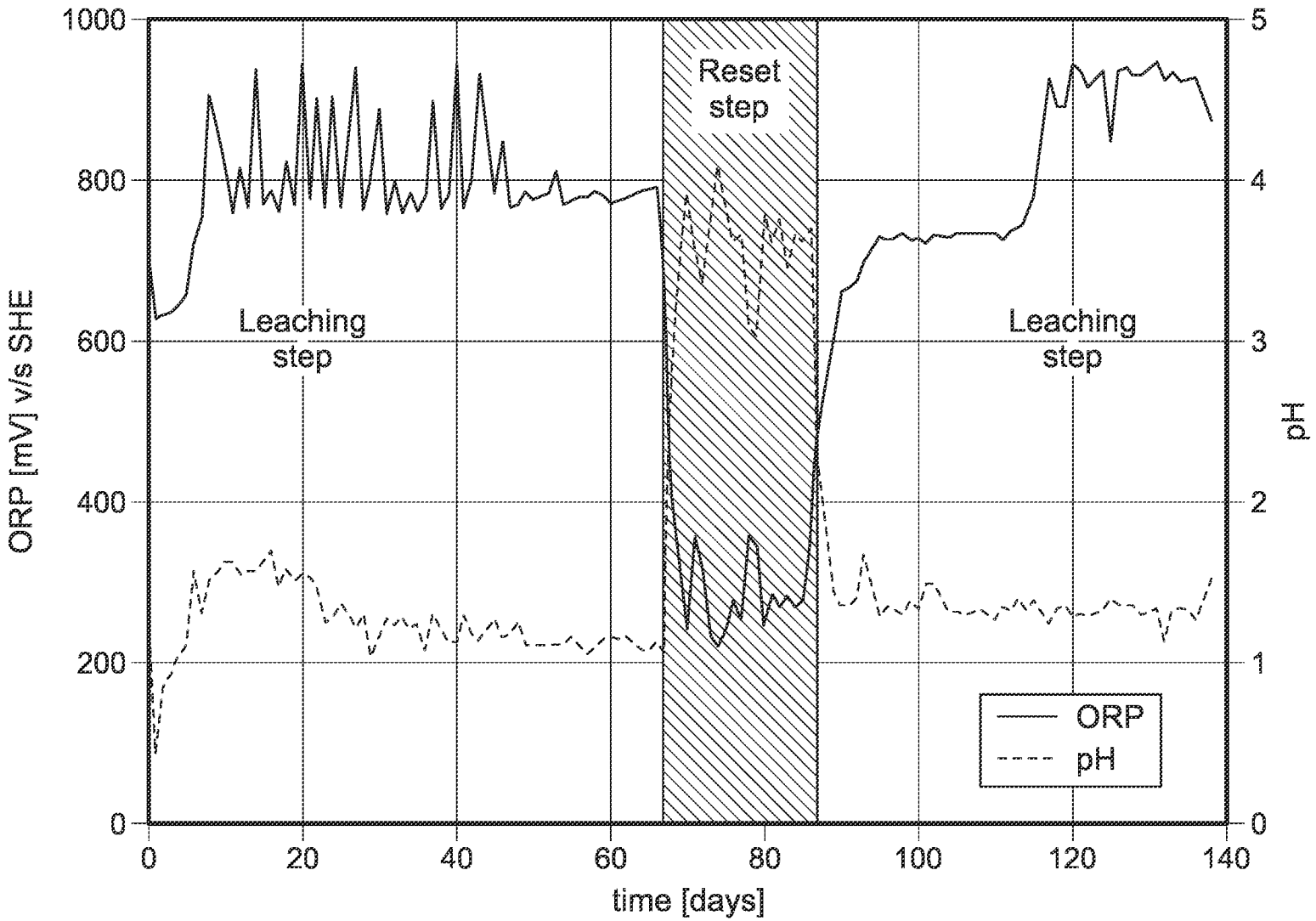
FIG. 6 is a detail of FIG. 5, depicting operational parameters (redox potential and pH conditions) using the resetting process according to an embodiment of the invention.

FIG. 5 depicts copper recovery with a leaching column system adapted for leaching copper sulfide ores, and FIG. 6 illustrates the pH and ORP measurements taken during the experimental phase. The copper ore, composed mainly of primary copper sulfide ore (about 84-95% of the contained copper as chalcopyrite), and to a lesser extent, secondary copper sulfide ore (up to 10% of the contained copper as covellite, and up to 10% of the contained ore as a chalcocite/ digenite), with an ore size of $P_{80}$ 0.18 inch, was first subjected to an agglomeration step with sulfuric acid and water. Then, the leaching column was filled with approximately 1 kg of the agglomerated ore. The loaded ore was subjected to a leaching step by irrigating the column with a leaching solution comprising microorganisms for 67 days (0.4% sulfuric acid; pH<2, irrigation rate 5 L/h/m$^2$; using $5\times10^6$ cel/mL of a consortium consisting primarily of *Acidithiobacillus ferrooxidans* and *Leptospirillum* spp). Following the copper recovery parameter in each of FIG. 5 and operating conditions in FIG. 6 over the course of time, it was found that no more copper in the mineral could be extracted after about day 60. The column was then treated with the reset solution (0.6 M sodium bisulfite; 10 mM citric acid; pH 3.5; irrigation rate 5 L/h/m$^2$), for the next 20 days. The reset solution treated the leached ore, allowing the hindered copper in the mineral to be available again. Finally, the column was again subjected to a leaching step with the same leaching solution containing microorganisms (0.4% sulfuric acid, pH<2; irrigation rate 5 L/h/m$^2$; $5\times10^6$ cel/mL of a consortium consisting primarily of *Acidithiobacillus ferrooxidans* and *Leptospirillum* spp). FIG. 5 shows the copper recovery achieved after applying the reset solution in the process, while FIG. 6 shows the operating parameters for the reset step. Further leaching-reset-leaching steps could be applied in the leaching column, as well as applied in a copper heap, in order to extract more copper from the respective sulfide ores.

Table IV depicts a summary of copper recovery with a leaching column system adapted for leaching copper sulfide ores. Two different leaching setups were used: acid leaching and nitrate leaching.

For the acid leaching, the copper ore, composed mainly of primary copper sulfide ore (about 84-95% of the contained copper as chalcopyrite), and to a lesser extent, secondary copper sulfide ore (up to 10% of the contained copper as covellite, and up to 10% of the contained ore as a chalcocite/digenite), and with an ore size of $P_{80}$0.18 inch, was first subjected to an agglomeration step with sulfuric acid and water. Then, the leaching column was filled with approximately 1 kg of agglomerated ore. The loaded ore was subjected to a leaching step by irrigating the column with a leaching solution comprising ferric ions for 39 days (10 g/L sulfuric acid; 5 g/L ferric ions; pH <2; irrigation rate 5 L/h/m$^2$). The column was then treated with a conditioning solution, comprising citric acid with citrate at pH 5, for 2 days. After this, the column was treated with the reset solution (0.6 M dithionite; 10 mM citric acid; pH 4.5; irrigation rate 5 L/h/m$^2$) for the next 20 days. The reset solution treated the leached ore, allowing the hindered copper in the mineral to be available again. Finally, the column was subjected to a leaching step with the same leaching solution of the first stage, for 7 days. To compare the effect of the reset step, a column with the same experimental design, but without the use of the reset step, was included. This column was subjected solely to the specified acid leaching conditions throughout the duration of the test.

For the nitrate leaching, the copper ore, composed mainly of primary copper sulfide ore (about 84-95% of the contained copper as chalcopyrite), and to a lesser extent, secondary copper sulfide ore (up to 10% of the contained copper as covellite, and up to 10% of the contained ore as a chalcocite/digenite), and with an ore size of $P_{80}$¾ inch, was first subjected to an agglomeration step with sulfuric acid, nitrate and water. Then, the leaching column was filled with approximately 1 kg of agglomerated ore. The loaded ore was subjected to a leaching step by irrigating the column with a leaching solution comprising nitrate anions for 39 days (10 g/L sulfuric acid, 7.5 g/L nitrate anions, pH<2; irrigation rate 5 L/h/m$^2$). It must be noted that around day 25, the operational parameters (pH and ORP) were altered in order to promote iron hydroxides precipitation, i.e. ore passivation. The column was then treated with a conditioning solution, comprising citric acid with citrate at pH 5, for 2 days. After this, the column was then treated with the reset solution (0.6 M dithionite, 10 mM citric acid, pH 4.5, irrigation rate 5 L/h/m$^2$) for the next 20 days. The reset solution treated the leached ore, allowing the hindered copper in the mineral to be available again. Finally, the column was subjected to a leaching step with the same leaching solution of the first stage, for 7 days. To compare the effect of the reset step, a column with the same experimental design, but without the use of the reset step, was included. This column was subjected solely to the specified nitrate leaching conditions throughout the duration of the test.

FIG. 4 shows the copper recovery achieved after applying the reset solution in the process, while FIG. 5 shows the operating parameters for the reset step. Further leaching-reset-leaching steps could be applied in the leaching column, as well as applied in a copper heap, in order to extract more copper from the respective sulfide ores.

TABLE IV

Leaching results using the reset step onto different leaching methods

| Column | Copper recovery [%] at day 68 | Enhanced copper extraction |
|---|---|---|
| Acid leaching | 24% | 1.37× |
| Acid leaching with reset step | 33% | |
| Nitrate leaching | 26% | 1.22× |
| Nitrate leaching with reset step | 33% | |

The term "Enhanced copper extraction" may be defined as an increase in copper recovery compared to the maximum recovery achieved with a given leaching solution for a given ore in a single leaching step (baseline). In the example of FIG. 5 a maximum copper recovery of 14% is attained at about 60 days. It is expected that these leaching days may vary when different leaching technologies are used. However, that maximum recovery will always be characterized by a levelling off the metal recovery curve after several days. After reset, further copper recovery is possible. The results depicted in FIG. 5 demonstrate a significant increase in copper extraction at the end of the second leaching step (day 140) with a copper extraction of 22.5%, meaning an enhanced copper extraction of 1.6×times compared to the baseline Using the techniques of the invention, an enhanced copper extraction of about 1.6× and about an average of 1.3× were observed in FIG. 5 and Table IV, respectively. This invention increases the overall copper extraction by 1.2× to 2× compared to the baseline. The operational conditions illustrated in FIG. 6, corresponding to the experiments depicted in FIG. 5, demonstrate the obligatory alterations of the ORP and pH that are required to facilitate the unlocking of the passivated copper ore with the reset solution, thus preparing the ore for the subsequent leaching step.

Example 4—Electronic Microscopy

Figure 7A:
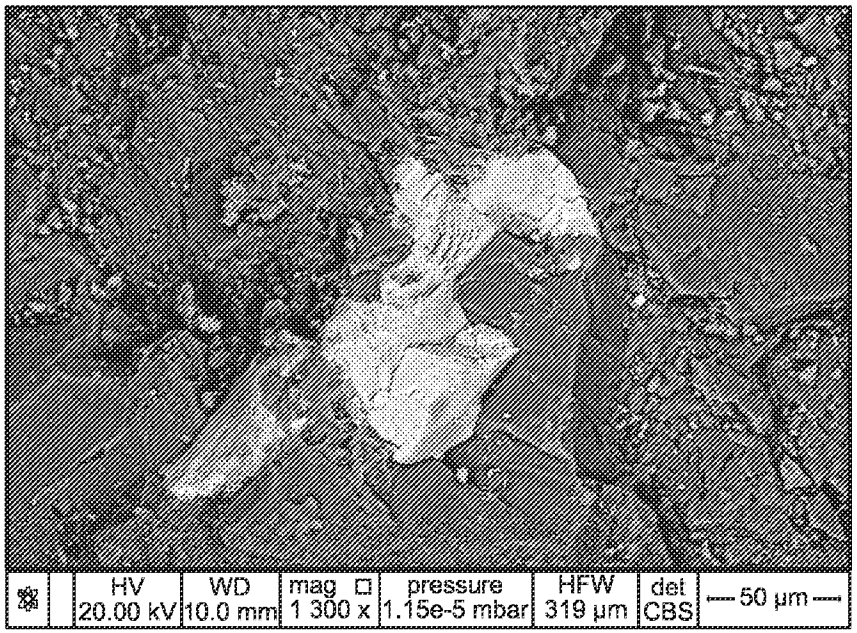
FIG. 7A, FIG. 7B, FIG. 7C, FIG. 7D, FIGS. 7E and 7F depict the effect of the reset solution on the surface of the passivated ore by means of scanning electron microscopy with energy dispersive X-ray spectroscopy spectral analyses (SEM-EDS).
Figure 7B:
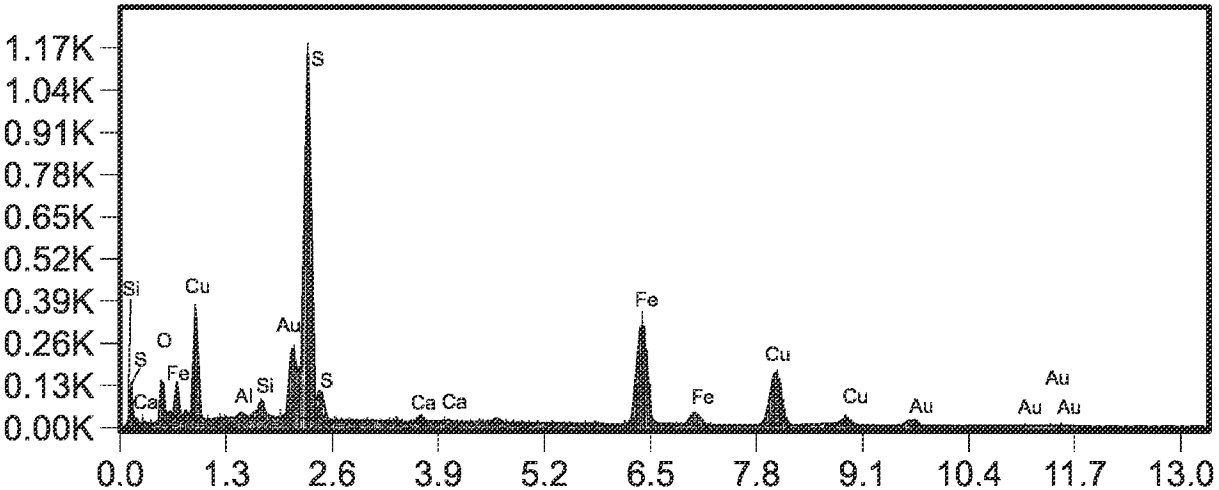
Figure 7C:
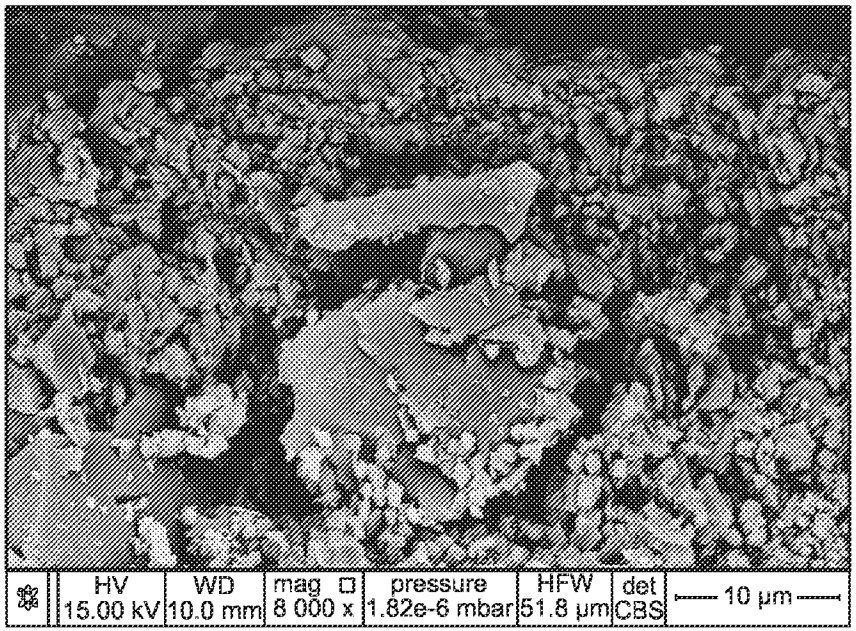
Figure 7D:
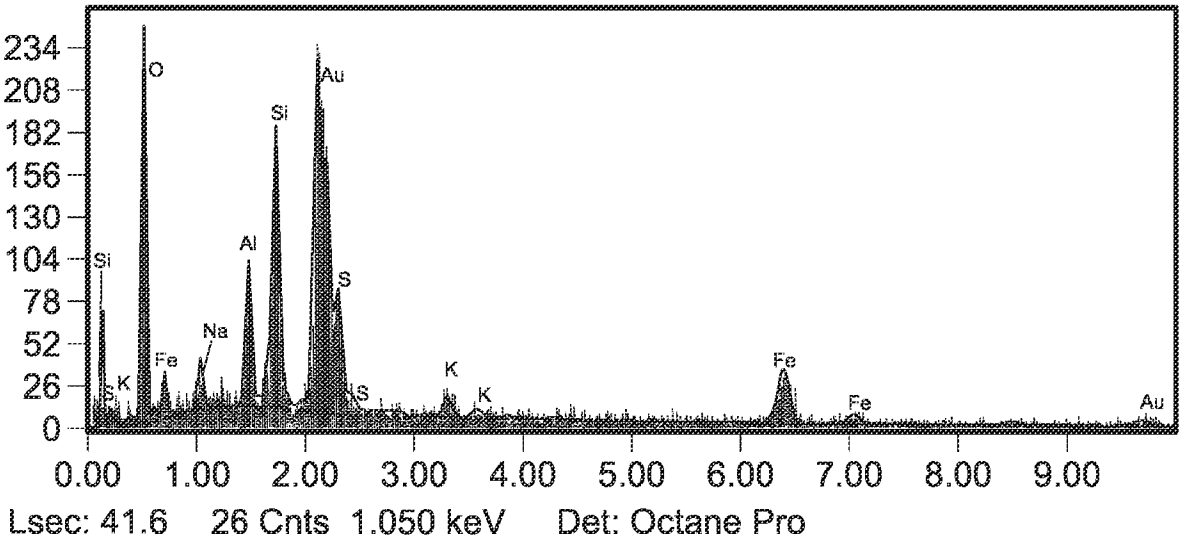
Figures 7E, 7F:
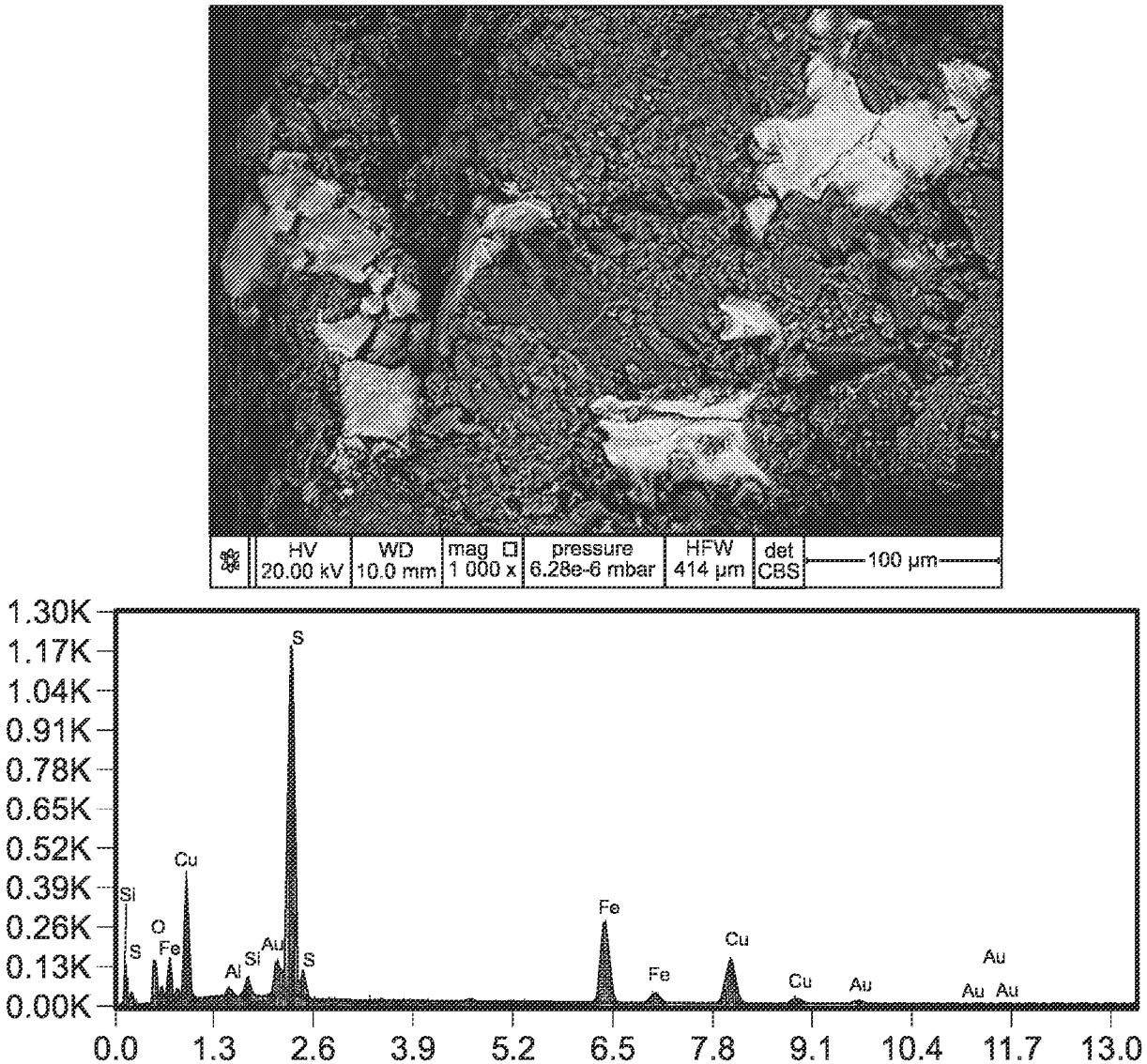

FIG. 7A, 7B, 7C, 7D, 7E and 7F depict the impact of the reset solution on the surface of the copper ore obtained from the column treated in accordance with the example illustrated in Table IV and FIG. 4. The surface of the samples was analyzed using scanning electron microscopy with energy-dispersive X-ray spectroscopy spectrum (SEM-EDS). In particular, the ore samples analyzed in FIG. 7A through FIG. 7F were obtained with the head ore without any leaching step, after the first leaching step, and after the application of the reset solution, respectively. SEM-EDS analysis of FIG. 7A and FIG. 7B shows the ore prior to the leaching step. On the surface of the ore there were no iron precipitates and there were zones with visual copper particles attributable to chalcopyrite available on the surface. The SEM-EDS analysis in FIG. 7C and FIG. 7D revealed that the ore surface was primarily covered with sulfur and precipitated iron, likely corresponding to jarosite. The presence of copper on the ore surface was low likely due to the precipitation of iron hydroxide and sulfur derived salts. By contrast, the analyses in FIG. 7E and FIG. 7F revealed that the treated ore surface had an increase in copper availability. These results demonstrate the effectiveness of the reset solution, and its corresponding reset stage, as an evident removal of the accumulation of iron and sulfur from the ore surface, thereby restoring the availability of copper for further leaching.

Example 5—Sulfur Removal

The effect of the reset solution may also be observed as the solubilization of undesirable species, such as elemental sulfur compounds, from the surface of the passivated ore. This allows copper occluded in the ore to be leached subsequently. Following the ore treatment, an increase in the presence of sulfur in the reset pregnant solution is expected, which is indicative of its solubilization.

Figure 8B:
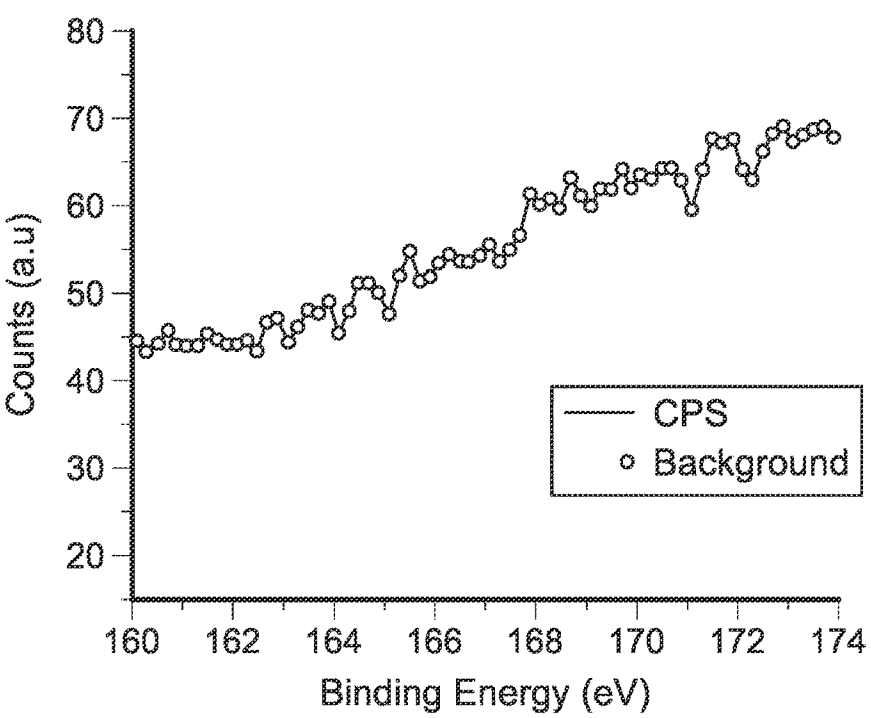
FIG. 8A and FIG. 8B depicts the effect of the reset solution on the surface of the passivate ore, by means of sulfur removal determined by X-ray photoelectron spectroscopy (XPS)
Figure 8A:
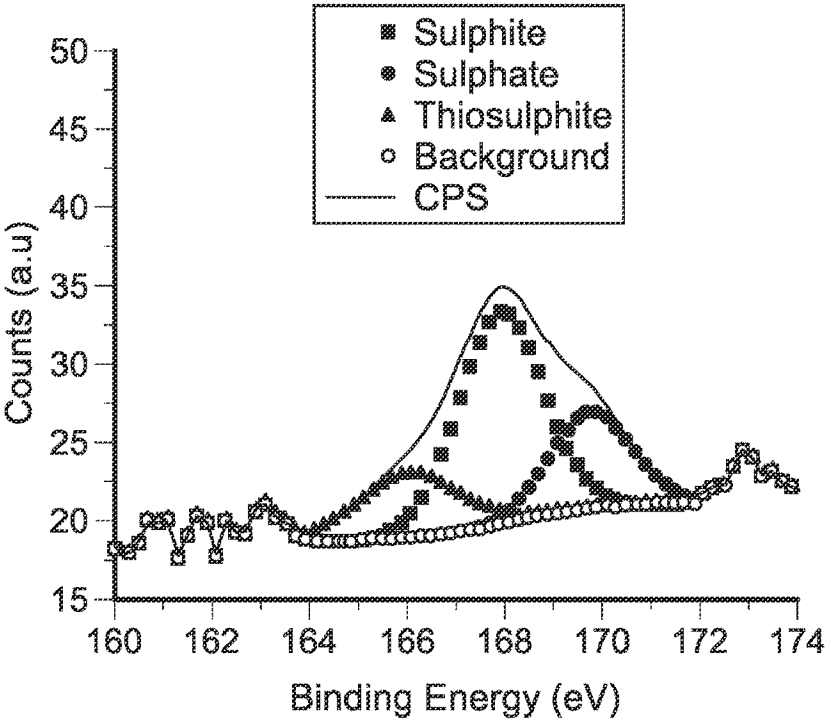

In a leaching column system, copper ore was leached following the conditions set forth Example 3—Table IV. After a leaching period of 39 days, columns were washed and subsequently discharged. A representative sample of the discharged material was taken and analyzed using X-ray photoelectron spectroscopy (XPS) to demonstrate the presence of sulfur-derived salts. In FIG. 8A and FIG. 8B, the intensity (counts per second) of the electrons was plotted against their binding energies (eV). This technique enables the identification of the chemical compound to which the surface-bound sulfur belongs. The results showed the presence of binding energy for signals attributable to sulfites, sulfates and/or thiosulfites in the passivated ore sample (FIG. 8A), but not in the treated sample (FIG. 8B), demonstrating the effectiveness of the reset solution in removing sulfur salts from the surface of passivated ores.

Finally, the aforesaid results demonstrate that the Reset solution, and the corresponding reset step, are capable of treating copper ore that has been previously leached and therefore passivated. This process effectively removes undesirable species, such as iron hydroxy compounds and sulfur compounds, which are typically formed when the ore is leached. Consequently, the treated ore can be prepared for further copper extraction through leaching without additional re-crushing or remining.

Different embodiments are disclosed herein. Features of certain embodiments may be combined with features of other embodiments; thus, certain embodiments may be combinations of features of multiple embodiments. Likewise, in the following claims a feature expressed in a dependent claim may be combined with a different independent claim and/or with the features of other dependent claims. The foregoing description of the embodiments of the invention has been presented for the purposes of illustration and description. It is not intended to be exhaustive or to limit the invention to the precise form disclosed. It should be appreciated by people skilled in the art that many modifications, variations, substitutions, changes, and equivalents are possible in light of the above teaching. It is, therefore, to be understood that the appended claims are intended to cover all such modifications and changes as fall within the true spirit of the invention.

While certain features of the invention have been illustrated and described herein, many modifications, substitutions, changes and equivalents will now occur to those of ordinary skill in the art. It is, therefore, to be understood that the appended claims are intended to cover all such modifications and changes as fall within the true spirit of the invention.

Unless explicitly stated, different process or method steps described herein with regard to different embodiments of the invention may not be constrained to a particular order or sequence. Additionally, some of the described method embodiments or elements thereof can occur or be performed simultaneously, at the same point in time, or concurrently.

The invention claimed is:

1. A method to improve recovery of copper from copper ore-containing material, comprising:

providing a heap of copper ore previously leached;

performing a reset step, wherein the heap of copper ore previously leached is irrigated with a reset solution comprising a chelating agent and a reducing agent; and performing a leaching step, wherein the irrigated heap from the reset step is further treated with a leaching solution comprising acid and a leaching agent to obtain a copper-enriched Pregnant Leaching Solution (PLS); and wherein said method further comprises a conditioning step, prior to performing the reset step, wherein the heap is irrigated with a conditioning solution having a pH in a range of 3.5 to 14.

2. The method according to claim 1, wherein said conditioning solution comprises a buffering agent.

3. The method according to claim 2, wherein said buffering agent in the conditioning solution is selected from the group consisting of citric acid, lactic acid, tartaric acid, ascorbic acid, salicylic acid, tetrasodium glutamate diacetate acid, ethylenediaminetetraacetic acid, pyruvic acid, succinic acid, aspartic acid, gallic acid, fumaric acid, malic acid, their conjugate bases, and a mixture thereof.

4. The method according to claim 3, wherein the buffering agent in the conditioning solution is in a concentration of above 50 mM.

5. The method according to claim 4, wherein the conditioning step is conducted up to the point in which the heap reaches a pH of at least 2.

6. The method according to claim 1, wherein the conditioning solution contains less than 0.1 mM of a reducing agent.

7. The method according to claim 1, wherein the conditioning, the reset and the leaching steps are cyclically repeated.

8. The method according to claim 1, wherein said copper ore provided comprises copper oxides, primary copper sulfides, secondary copper sulfides, or a mixture thereof.

9. The method according to claim 1, wherein said ore provided is primarily chalcopyrite.

10. The method according to claim 1, wherein said reset solution used in the reset step has a redox potential in a range of 200 to 700 mV and a pH in a range 2 to 6.

11. The method according to claim 1, wherein said chelating agent in the reset solution is selected from the group consisting of citric acid, lactic acid, tartaric acid, ascorbic acid, salicylic acid, tetrasodium glutamate diacetate acid, ethylenediaminetetraacetic acid, pyruvic acid, succinic acid, aspartic acid, gallic acid, fumaric acid, malic acid, gluconic acid, their conjugate bases, or a mixture thereof.

12. The method according to claim 1, wherein said reducing agent in the reset solution is a reagent selected from the group consisting of bisulfite ion, dithionite ion, metabisulfite ion, and a mixture thereof.

13. The method according to claim 1, wherein a ratio of said chelating agent and said reducing agent in the reset solution on a molar basis, is between 4:1 to 1:100.

* * * * *